US011199795B2

(12) United States Patent
Uchiyama et al.

(10) Patent No.: US 11,199,795 B2
(45) Date of Patent: Dec. 14, 2021

(54) IMAGE HEATING DEVICE AND IMAGE FORMING APPARATUS

(71) Applicant: CANON KABUSHIKI KAISHA, Tokyo (JP)

(72) Inventors: Takahiro Uchiyama, Mishima (JP); Masato Sako, Mishima (JP); Hideaki Yonekubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 16/847,875

(22) Filed: Apr. 14, 2020

(65) Prior Publication Data

US 2020/0333732 A1 Oct. 22, 2020

(30) Foreign Application Priority Data

Apr. 16, 2019 (JP) ..... JP2019-078069

(51) Int. Cl.
*G03G 15/20* (2006.01)

(52) U.S. Cl.
CPC ..... *G03G 15/2017* (2013.01)

(58) Field of Classification Search
CPC ..... G03G 15/2017; G03G 15/2042; G03G 15/2053; G03G 2215/2035
See application file for complete search history.

(56) References Cited

U.S. PATENT DOCUMENTS 10,054,882 B2 8/2018 Nomura et al.
10,268,144 B2 * 4/2019 Iwasaki ..... G03G 13/20
10,545,435 B2 1/2020 Uchiyama et al.
2013/0322908 A1 * 12/2013 Ogura ..... G03G 15/80 399/69
2018/0004134 A1 * 1/2018 Nomura ..... G03G 15/2017
2019/0227466 A1 * 7/2019 Nomura ..... G03G 15/2042
2019/0354047 A1 * 11/2019 Uchiyama ..... G03G 15/2039
2020/0096921 A1 3/2020 Uchiyama
(Continued)

FOREIGN PATENT DOCUMENTS

JP 06-095540 A 4/1994
JP 2018-120117 A 8/2018

OTHER PUBLICATIONS

Co-Pending, unpublished U.S. Appl. No. 16/847,867, filed Apr. 14, 2020.

(Continued)

*Primary Examiner* — Francis C Gray
(74) *Attorney, Agent, or Firm* — Venable LLP

(57) ABSTRACT

In an image heating device, a plurality of count values representing a heat storage amount in each of a plurality of heating regions heated by a plurality of heating elements are acquired, and electric power for the heating elements is controlled so that a difference between a heat storage maximum count value representing the heat storage amount of the heating region in which the heat storage amount is the largest among the plurality of heating regions, and a heat storage reduction count value representing the heat storage amount of a heat storage reduction region that is a heating region having a smaller heat storage amount than the heating region having the maximum heat storage amount, is maintained within a range of a predetermined value; and the predetermined value is set based on a width of the heat storage reduction region of a recording material.

11 Claims, 22 Drawing Sheets

(56) References Cited

U.S. PATENT DOCUMENTS

| | | | |
|---|---|---|---|
| 2020/0125014 | A1 | 4/2020 | Uchiyama et al. |
| 2020/0166876 | A1 | 5/2020 | Yonekubo |

OTHER PUBLICATIONS

Co-Pending, unpublished U.S. Appl. No. 16/853,919, filed Apr. 21, 2020.
Co-Pending, unpublished U.S. Appl. No. 16/943,193, filed Jul. 30, 2020.

* cited by examiner

FIG.7B <CLASSIFICATION BY IMAGE INFORMATION>

| | A1 | A2 | A3 | A4 | A5 | A6 | A7 |
|---|---|---|---|---|---|---|---|
| T1 | AI | AI | AI | AI | AP | AP | AP |
| T2 | AP | AI | AI | AI | AI | AI | AP |
| T3 | AP | AI | AI | AI | AI | AI | AP |
| T4 | AP | AI | AI | AI | AI | AI | AP |
| T5 | AP | AI | AI | AI | AI | AI | AP |

FIG.8A SET VALUE OF HEATING COUNT TC

| TGT(℃) | TC |
|---|---|
| 200<TGT≦205 | 1.1 |
| 195<TGT≦200 | 1.0 |
| 190<TGT≦195 | 0.9 |
| 185<TGT≦190 | 0.7 |
| 105<TGT≦185 | 0.5 |
| TGT≦105 | 0.4 |

FIG.8B SET VALUE OF IMAGE DISTANCE COUNT HLC

| HL(mm) | HLC |
|---|---|
| HL≦50 | 1 |
| 50<HL≦100 | 2 |
| 100<HL≦150 | 3 |
| 150<HL≦200 | 4 |
| 200<HL≦250 | 5 |
| 250<HL≦300 | 6 |
| 300<HL≦400 | 7 |
| 400<HL | 8 |

FIG.8D

| | |
|---|---|
| RISE-UP COUNT | WUC=2.0 |
| PAPER INTERVAL COUNT | INC=0.5 |
| POST-ROTATION COUNT | PC=1.0 |
| RECORFING MATERIAL PASSING COUNT | RMC=0.4 |
| HEAT DISSIPATION COUNT | DC=0.1 |

FIG.8C SET VALUE OF PAPER PASSING DISTANCE COUNT PLC

| PL(mm) | PLC |
|---|---|
| PL≦50 | 1 |
| 50<PL≦100 | 2 |
| 100<PL≦150 | 3 |
| 150<PL≦200 | 4 |
| 200<PL≦250 | 5 |
| 250<PL≦300 | 6 |
| 300<PL≦400 | 7 |
| 400<PL | 8 |

FIG.8E SET VALUES OF IMAGE HEATING REGION TEMPERATURE CORRECTION TERM $K_{AI}$ AND NON-IMAGE HEATING REGION TEMPERATURE CORRECTION TERM $K_{AP}$

| CTi | $K_{AI}$ | $K_{AP}$ |
|---|---|---|
| 20≦CTi<50 | 2 | 2 |
| 50≦CTi<100 | 5 | 5 |
| 100≦CTi<150 | 10 | 10 |
| 150≦CTi<200 | 15 | 15 |
| 200≦CTi | 20 | 20 |

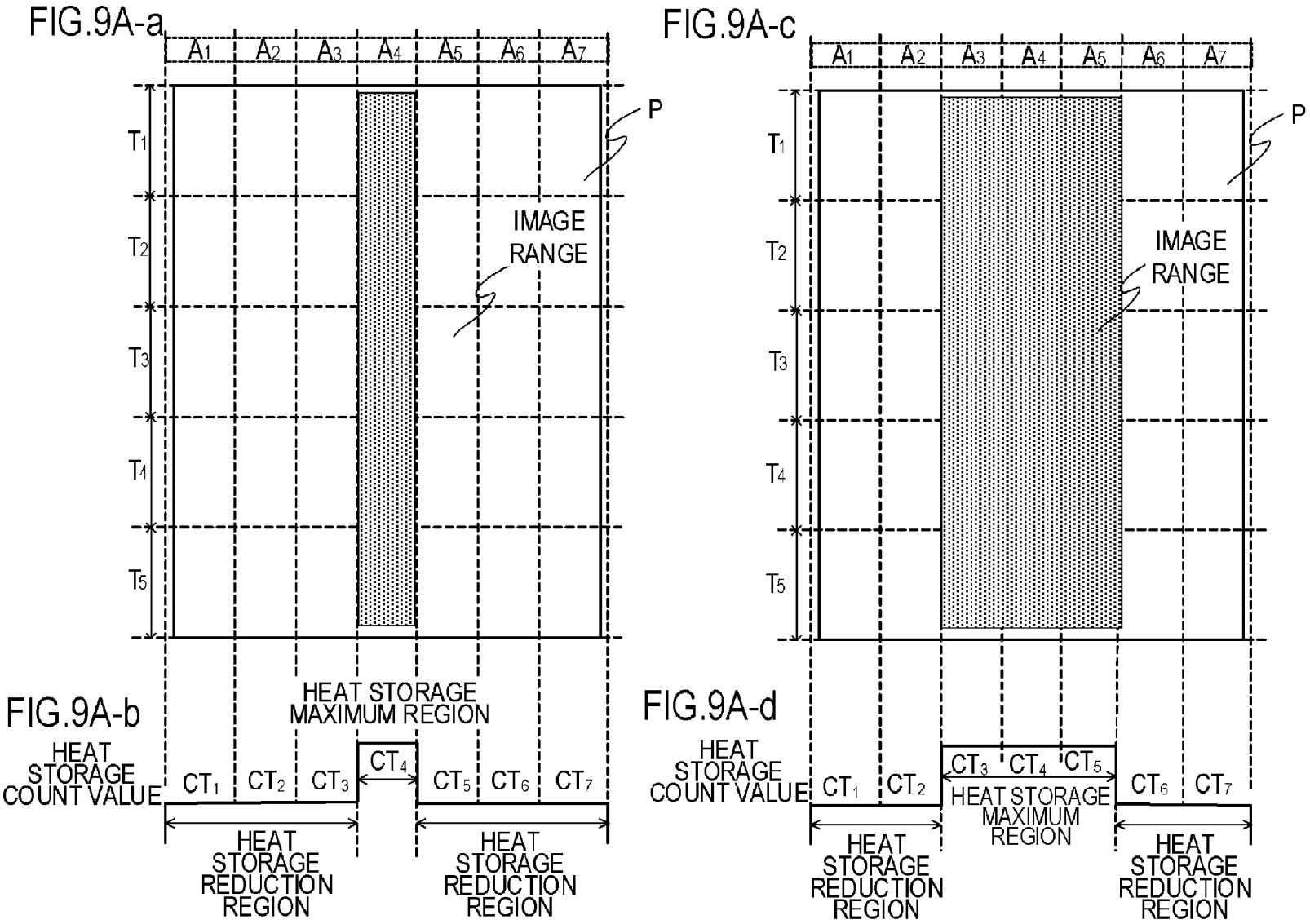
FIG.9A-a
P
IMAGE RANGE
A1
A2
A3
A4
A5
A6
A7
T1
T2
T3
T4
T5
FIG.9A-b
HEAT STORAGE COUNT VALUE
CT1
CT2
CT3
CT4
CT5
CT6
CT7
HEAT STORAGE MAXIMUM REGION
HEAT STORAGE REDUCTION REGION
FIG.9A-c
P
IMAGE RANGE
A1
A2
A3
A4
A5
A6
A7
T1
T2
T3
T4
T5
FIG.9A-d
HEAT STORAGE COUNT VALUE
CT1
CT2
CT3
CT4
CT5
CT6
CT7
HEAT STORAGE MAXIMUM REGION
HEAT STORAGE REDUCTION REGION

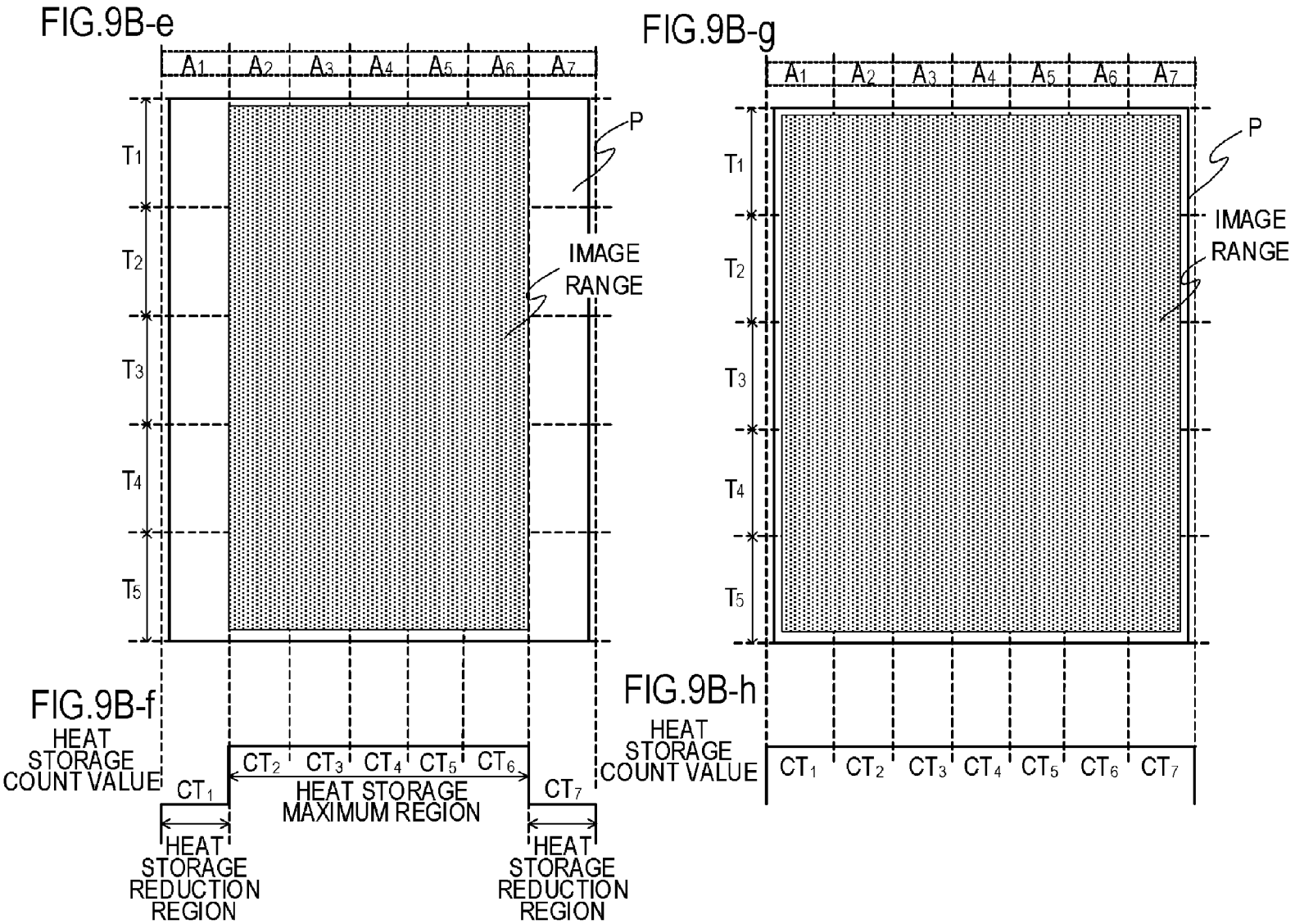
FIG.9B-e
FIG.9B-f
FIG.9B-g
FIG.9B-h
P
IMAGE RANGE
A1
A2
A3
A4
A5
A6
A7
T1
T2
T3
T4
T5
CT1
CT2
CT3
CT4
CT5
CT6
CT7
HEAT STORAGE COUNT VALUE
HEAT STORAGE REDUCTION REGION
HEAT STORAGE MAXIMUM REGION

FIG.11A

PAPER PASSING CONDITION 1 OF EMBODIMENT 1

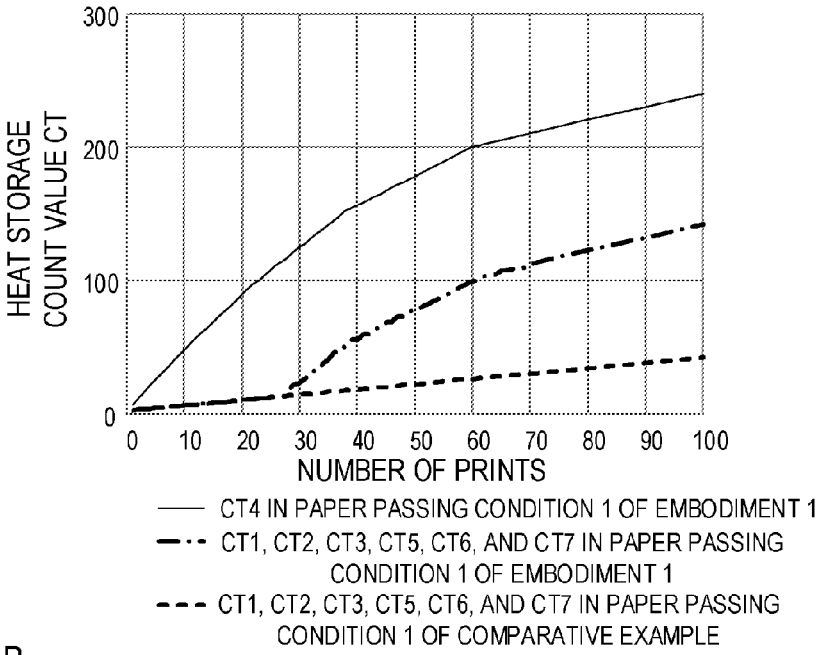

FIG.11B

PAPER PASSING CONDITION 1 OF EMBODIMENT 1

| PAPER PASSING NUMBER | CONTROL TEMPERATURE | | | HEAT STORAGE COUNT VALUE | | | HEAT STORAGE COUNT VALUE DIFFERENCE | | OCCURRENCE OF FILM DAMAGE |
|---|---|---|---|---|---|---|---|---|---|
| | $A_1 \sim A_3$ | $A_4$ | $A_5 \sim A_7$ | $CT_1 \sim CT_3$ | $CT_4$ | $CT_5 \sim CT_7$ | $CTmax-CT_L$ | $CTmax-CT_R$ | |
| 10 | 105 | 203 | 105 | 6.5 | 48.5 | 6.5 | 42.0 | 42.0 | NO |
| 20 | 105 | 200 | 105 | 10.5 | 89.1 | 10.5 | 78.6 | 78.6 | NO |
| 27 | 105 | 195 | 105 | 13.3 | 114.7 | 13.3 | 101.4 | 101.4 | NO |
| 28 | 205 | 195 | 205 | 17.9 | 118.1 | 17.9 | 100.2 | 100.2 | NO |
| 50 | 200 | 190 | 200 | 77.7 | 178.5 | 77.7 | 100.8 | 100.8 | NO |
| 70 | 195 | 185 | 195 | 112.7 | 210.5 | 112.7 | 97.8 | 97.8 | NO |
| 100 | 195 | 185 | 195 | 142.7 | 240.5 | 142.7 | 97.8 | 97.8 | NO |

FIG.11C

PAPER PASSING CONDITION 1 OF COMPARATIVE EXAMPLE

| PAPER PASSING NUMBER | CONTROL TEMPERATURE | | | HEAT STORAGE COUNT VALUE | | | HEAT STORAGE COUNT VALUE DIFFERENCE | | OCCURRENCE OF FILM DAMAGE |
|---|---|---|---|---|---|---|---|---|---|
| | $A_1 \sim A_3$ | $A_4$ | $A_5 \sim A_7$ | $CT_1 \sim CT_3$ | $CT_4$ | $CT_5 \sim CT_7$ | $CTmax-CT_L$ | $CTmax-CT_R$ | |
| 10 | 105 | 203 | 105 | 6.5 | 48.5 | 6.5 | 42.0 | 42.0 | NO |
| 20 | 105 | 200 | 105 | 10.5 | 89.1 | 10.5 | 78.6 | 78.6 | NO |
| 50 | 100 | 190 | 100 | 22.5 | 178.5 | 22.5 | 156.0 | 156.0 | YES |
| 70 | 95 | 185 | 95 | 30.5 | 210.5 | 30.5 | 180.0 | 180.0 | YES |
| 100 | 95 | 185 | 95 | 42.5 | 240.5 | 42.5 | 198.0 | 198.0 | YES |

FIG.12A

PAPER PASSING CONDITION 2 OF EMBODIMENT 1

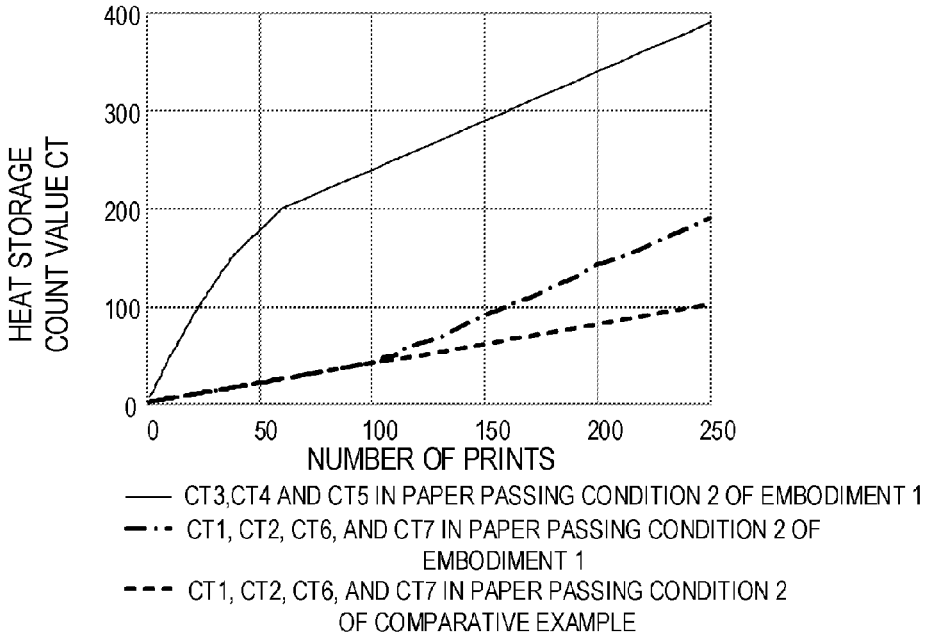

FIG.12B

PAPER PASSING CONDITION 2 OF EMBODIMENT 1

| PAPER PASSING NUMBER | CONTROL TEMPERATURE | | | HEAT STORAGE COUNT VALUE | | | HEAT STORAGE COUNT VALUE DIFFERENCE | | OCCURRENCE OF FILM DAMAGE |
|---|---|---|---|---|---|---|---|---|---|
| | $A_1$、$A_2$ | $A_3$～$A_5$ | $A_6$、$A_7$ | $CT_1$、$CT_2$ | $CT_3$～$CT_5$ | $CT_6$、$CT_7$ | $CTmax-CT_L$ | $CTmax-CT_R$ | |
| 50 | 103 | 190 | 103 | 22.5 | 178.5 | 22.5 | 156.0 | 156.0 | NO |
| 100 | 103 | 185 | 103 | 42.5 | 240.5 | 42.5 | 198.0 | 198.0 | NO |
| 104 | 103 | 185 | 103 | 44.1 | 244.5 | 44.1 | 200.4 | 200.4 | NO |
| 105 | 203 | 185 | 203 | 48.7 | 245.5 | 48.7 | 196.8 | 196.8 | NO |
| 150 | 200 | 185 | 200 | 91.9 | 290.5 | 91.9 | 198.6 | 198.6 | NO |
| 200 | 195 | 185 | 195 | 143.1 | 340.5 | 143.1 | 197.4 | 197.4 | NO |
| 250 | 190 | 185 | 190 | 191.3 | 390.5 | 191.3 | 199.2 | 199.2 | NO |

FIG.12C

PAPER PASSING CONDITION 2 OF COMPARATIVE EXAMPLE

| PAPER PASSING NUMBER | CONTROL TEMPERATURE | | | HEAT STORAGE COUNT VALUE | | | HEAT STORAGE COUNT VALUE DIFFERENCE | | OCCURRENCE OF FILM DAMAGE |
|---|---|---|---|---|---|---|---|---|---|
| | $A_1$、$A_2$ | A～$A_5$ | $A_6$、$A_7$ | $CT_1$、$CT_2$ | $CT_3$～$CT_5$ | $CT_6$、$CT_7$ | $CTmax-CT_L$ | $CTmax-CT_R$ | |
| 50 | 103 | 190 | 103 | 22.5 | 178.5 | 22.5 | 156.0 | 156.0 | NO |
| 100 | 103 | 185 | 103 | 42.5 | 240.5 | 42.5 | 198.0 | 198.0 | NO |
| 200 | 100 | 185 | 100 | 82.5 | 340.5 | 82.5 | 258.0 | 258.0 | YES |
| 250 | 85 | 185 | 95 | 102.5 | 390.5 | 102.5 | 288.0 | 288.0 | YES |

FIG.13A

PAPER PASSING CONDITION 3 OF EMBODIMENT 1

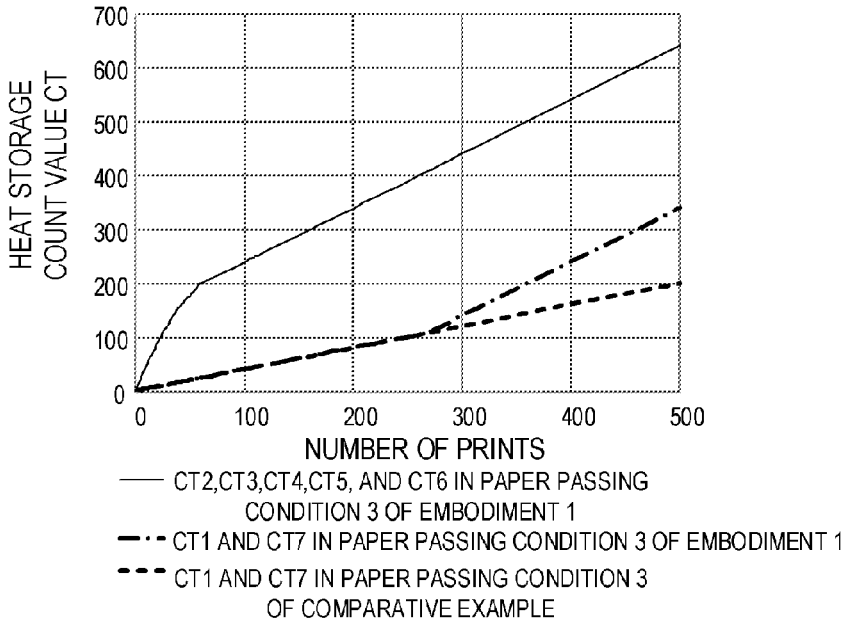

FIG.13B

PAPER PASSING CONDITION 3 OF EMBODIMENT 1

| PAPER PASSING NUMBER | CONTROL TEMPERATURE | | | HEAT STORAGE COUNT VALUE | | | HEAT STORAGE COUNT VALUE DIFFERENCE | | OCCURRENCE OF FILM DAMAGE |
|---|---|---|---|---|---|---|---|---|---|
| | $A_1$ | $A_2 \sim A_6$ | $A_7$ | $CT_1$ | $CT_2 \sim CT_6$ | $CT_7$ | $CTmax-CT_L$ | $CTmax-CT_R$ | |
| 100 | 103 | 185 | 103 | 42.5 | 240.5 | 42.5 | 198.0 | 198.0 | NO |
| 200 | 100 | 185 | 100 | 82.5 | 340.5 | 82.5 | 258.0 | 258.0 | NO |
| 270 | 95 | 185 | 95 | 110.5 | 410.5 | 110.5 | 300.0 | 300.0 | NO |
| 271 | 195 | 185 | 195 | 113.9 | 411.5 | 113.9 | 297.6 | 297.6 | NO |
| 300 | 195 | 185 | 195 | 143.5 | 440.5 | 143.5 | 297.0 | 297.0 | NO |
| 400 | 185 | 185 | 185 | 241.1 | 540.5 | 241.1 | 299.4 | 299.4 | NO |
| 500 | 185 | 185 | 185 | 341.1 | 640.5 | 341.1 | 299.4 | 299.4 | NO |

FIG.13C

PAPER PASSING CONDITION 3 OF COMPARATIVE EXAMPLE

| PAPER PASSING NUMBER | CONTROL TEMPERATURE | | | HEAT STORAGE COUNT VALUE | | | HEAT STORAGE COUNT VALUE DIFFERENCE | | OCCURRENCE OF FILM DAMAGE |
|---|---|---|---|---|---|---|---|---|---|
| | $A_1$ | $A_2 \sim A_6$ | $A_7$ | $CT_1$ | $CT_2 \sim CT_6$ | $CT_7$ | $CTmax-CT_L$ | $CTmax-CT_R$ | |
| 100 | 103 | 185 | 103 | 42.5 | 240.5 | 42.5 | 198.0 | 198.0 | NO |
| 200 | 100 | 185 | 100 | 82.5 | 340.5 | 82.5 | 258.0 | 258.0 | NO |
| 400 | 90 | 185 | 90 | 162.5 | 540.5 | 162.5 | 378.0 | 378.0 | YES |
| 500 | 85 | 185 | 85 | 202.5 | 640.5 | 202.5 | 438.0 | 438.0 | YES |

SPECIFIC EXAMPLE OF EMBODIMENT 2

| PAPER PASSING NUMBER | CONTROL TEMPERATURE | | | | | HEAT STORAGE COUNT VALUE | | | | | | | HEAT STORAGE COUNT VALUE DIFFERENCE | |
|---|---|---|---|---|---|---|---|---|---|---|---|---|---|---|
| | $A_1$、$A_2$ | A3 | $A_4$ | A5 | $A_6$、$A_7$ | $CT_1$、$CT_2$ | CT3 | $CT_4$ | CT5 | $CT_6$、$CT_7$ | $CT_{LAVE}$ | $CT_{RAVE}$ | $CT_{max}-CT_{LAVE}$ | $CT_{max}-CT_{RAVE}$ |
| 10 | 105 | 103 | 203 | 103 | 105 | 6.5 | 31.7 | 48.5 | 31.7 | 6.5 | 14.9 | 14.9 | 33.6 | 33.6 |
| 37 | 105 | 95 | 195 | 95 | 105 | 17.3 | 108.5 | 148.7 | 108.5 | 17.3 | 47.7 | 47.7 | 101.0 | 101.0 |
| 38 | 203 | 195 | 195 | 195 | 203 | 21.9 | 111.9 | 152.1 | 111.9 | 21.9 | 51.9 | 51.9 | 100.2 | 100.2 |
| 49 | 203 | 190 | 195 | 190 | 203 | 47.3 | 140.3 | 176.3 | 140.3 | 47.3 | 78.3 | 78.3 | 98.0 | 98.0 |
| 77 | 200 | 185 | 185 | 190 | 200 | 84.3 | 191.1 | 217.5 | 191.1 | 84.3 | 119.9 | 119.9 | 97.6 | 97.6 |
| 97 | 195 | 185 | 185 | 185 | 195 | 103.1 | 212.3 | 237.5 | 212.3 | 139.5 | 139.5 | 139.5 | 98.0 | 98.0 |

| | $A_1$ | $A_2$ | $A_3$ | $A_4$ | $A_5$ | $A_6$ | $A_7$ |
|---|---|---|---|---|---|---|---|
| HEATING REGION WIDTH | 5.0mm | 12.5mm | 17.5mm | 150.0mm | 17.5mm | 12.5mm | 5.0mm |

FIG.20

| Tri | $K_{AI}$ | $K_{AP}$ |
|---|---|---|
| 60≦Tri<70 | 2 | 2 |
| 70≦Tri<90 | 5 | 5 |
| 90≦Tri<110 | 10 | 10 |
| 110≦Tri<130 | 15 | 15 |
| 130≦Tri | 20 | 20 |

IMAGE HEATING DEVICE AND IMAGE FORMING APPARATUS

BACKGROUND OF THE INVENTION

Field of the Invention

The present invention relates to an image heating device such as a fixing device mounted on an image forming apparatus such as a copying machine or a printer using an electrophotographic method or an electrostatic recording method, or a gloss imparting device that increases glossiness of a toner image by reheating the fixed toner image on a recording material. The present invention also relates to an image forming apparatus including the image heating device.

Description of the Related Art

An image heating device such as a fixing device or a gloss imparting device used in an electrophotographic image forming apparatus (hereinafter, referred to as an image forming apparatus) such as a copying machine or a printer has been proposed in which an image portion formed on a recording material is selectively heated to due to a demand for power saving (Japanese Patent Application Publication H06-95540). With such a method, the heat generation range of a heater is divided into a plurality of heating blocks in the longitudinal direction of the heater (a direction orthogonal to the conveyance direction of the recording material), and heat generation in each heating block is selectively controlled according to the presence or absence of an image on the recording material. That is, power saving is achieved by stopping power supply to the heating block in a portion where no image is present on the recording material (non-image portion).

Further, a technique for increasing power saving while suppressing the occurrence of a recording material conveyance failure and reduction in durability of a fixing member has been proposed for such a heat fixing device that selectively heats an image portion formed on a recording material (Japanese Patent Application Publication 2018-120117).

SUMMARY OF THE INVENTION

However, in an image heating device in which heat generation control is performed at a different control temperature for each heating block, a recording material conveyance failure such as a paper wrinkle or a trailing edge warp, or load applied to a fixing member (a constituent member of the image heating device) used in the image heating device may increase and durability may decrease. That is, since the heat generation amount of each heating block differs depending on the image pattern on the passing recording material, the heat storage state of the fixing member differs among the heating blocks. Since the pressure roller used for the fixing member thermally expands according to a heat storage amount, a difference occurs in the rotational driving force of the pressure roller among the heating blocks. Therefore, there is a possibility that a force deviating the fixing film in one direction will increase due to the rotational driving force difference in the longitudinal direction, and the durability of the fixing film, the pressure roller and the like will be reduced.

Further, the heat fixing device disclosed in Japanese Patent Application Publication 2018-120117 is configured to control the heat generation amount of heating elements so that a heat storage amount in a heating region heated by one of the plurality of heating elements and a heat storage amount in a heating region heated by the other heating elements is maintained within a predetermined range. As a result, the conveyance failure of the recording material is suppressed, and the force deviating the fixing film in one direction is reduced. However, when there is a difference in the heat storage amount among the heating regions heated by the plurality of heating elements of the heating device, the wider is the heating region, the stronger is the force deviating the fixing film in one direction, and it is possible that the durability of the fixing film, the pressure roller and the like will be reduced.

An object of the present invention is to provide an image heating device and an image forming apparatus which are excellent in power saving while suppressing a decrease in durability of constituent members.

In order to achieve the above object, the image heating device of the present invention comprising:

a heating unit including a heater for heating an image formed on a recording material, wherein the heater having a plurality of heating elements arranged side by side in a direction perpendicular to a conveyance direction of the recording material; and a control portion that individually controls electric power supplied to the plurality of heating elements; wherein the device has an acquisition portion that acquires a plurality of count values representing a heat storage amount in each of a plurality of heating regions heated by the plurality of heating elements, the control portion controls electric power supplied to the plurality of heating elements so that a difference between a heat storage maximum count value and a heat storage reduction count value is maintained within a range of a predetermined value, the heat storage maximum count value is the count value representing the heat storage amount of the heating region in which the heat storage amount is the largest among the plurality of heating regions, the heat storage reduction count value is the count value representing the heat storage amount of a heat storage reduction region that is a heating region having a smaller heat storage amount than the heating region having the maximum heat storage amount among the plurality of heating regions, and the predetermined value is set based on a width of the heat storage reduction region in the direction orthogonal to the conveyance direction.

In order to achieve the above object, the image heating device of the present invention comprising:

a heating unit including a heater for heating an image formed on a recording material, wherein the heater having a plurality of heating elements arranged side by side in a direction perpendicular to a conveyance direction of the recording material; and a control portion that individually controls electric power supplied to the plurality of heating elements; wherein the device estimates the temperature of constituent members constituting the device and the temperature of the recording material in real time during an image forming operation of an image forming apparatus equipped with the device, and has an acquisition portion that acquires estimated temperatures of a plurality of regions of the constituent members corresponding to each of the plurality of heating regions heated by the plurality of heating elements;

the control portion sets a heating region corresponding to a region where the estimated temperature is highest among the plurality of regions as a heat storage maximum region, sets a heating region corresponding to a region where the estimated temperature is lower than in the region where the estimated temperature is highest among the plurality of regions as a heat storage reduction region, and controls electric power supplied to the plurality of heating elements so that a difference between the estimated temperature of the heat storage maximum region and the estimated temperature of the heat storage reduction region is maintained within a predetermined range, and the predetermined value is set based on a width of the heat storage reduction region in a direction orthogonal to the conveyance direction.

In order to achieve the above object, the image forming apparatus of the present invention comprising:

an image forming portion that forms an image on a recording material; and a fixing portion that fixes the image formed on the recording material to the recording material;

the fixing portion including:

a heating unit including a heater for heating the image formed on a recording material, wherein the heater having a plurality of heating elements arranged side by side in a direction perpendicular to a conveyance direction of the recording material; and a control portion that individually controls electric power supplied to the plurality of heating elements; wherein the apparatus has an acquisition portion that acquires a plurality of count values representing a heat storage amount in each of a plurality of heating regions heated by the plurality of heating elements, the control portion controls electric power supplied to the plurality of heating elements so that a difference between a heat storage maximum count value and a heat storage reduction count value is maintained within a range of a predetermined value;

the heat storage maximum count value is the count value representing the heat storage amount of the heating region in which the heat storage amount is the largest among the plurality of heating regions;

the heat storage reduction count value is the count value representing the heat storage amount of a heat storage reduction region that is a heating region having a smaller heat storage amount than the heating region having the maximum heat storage amount among the plurality of heating regions, and the predetermined value is set based on a width of the heat storage reduction region in the direction orthogonal to the conveyance direction.

According to the present invention, it is possible to provide an image heating device and an image forming apparatus which are excellent in power saving while suppressing a decrease in durability of constituent members.

Further features of the present invention will become apparent from the following description of exemplary embodiments with reference to the attached drawings.

BRIEF DESCRIPTION OF THE DRAWINGS

FIGS. 7A and 7B are diagrams of a specific example regarding the classification of heating regions according to Embodiment 1;

FIGS. 8A to 8E show set values of parameters related to the control temperature in Embodiment 1;

FIGS. 9A-a to 9A-d are diagrams showing the relationship between the heat storage reduction region width LCW and film damage in Embodiment 1;

FIGS. 9B-e to 9B-h are diagrams showing the relationship between the heat storage reduction region width LCW and film damage in Embodiment 1;

FIGS. 11A to 11C are diagrams illustrating the effect exerted in Embodiment 1;

FIGS. 12A to 12C are diagrams illustrating the effect exerted in Embodiment 1;

FIGS. 13A to 13C are diagrams illustrating the effect exerted in Embodiment 1;

FIG. 20 shows set values of parameters related to the control temperature in Embodiment 3.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

1. Configuration of Image Forming Apparatus

Figure 1:
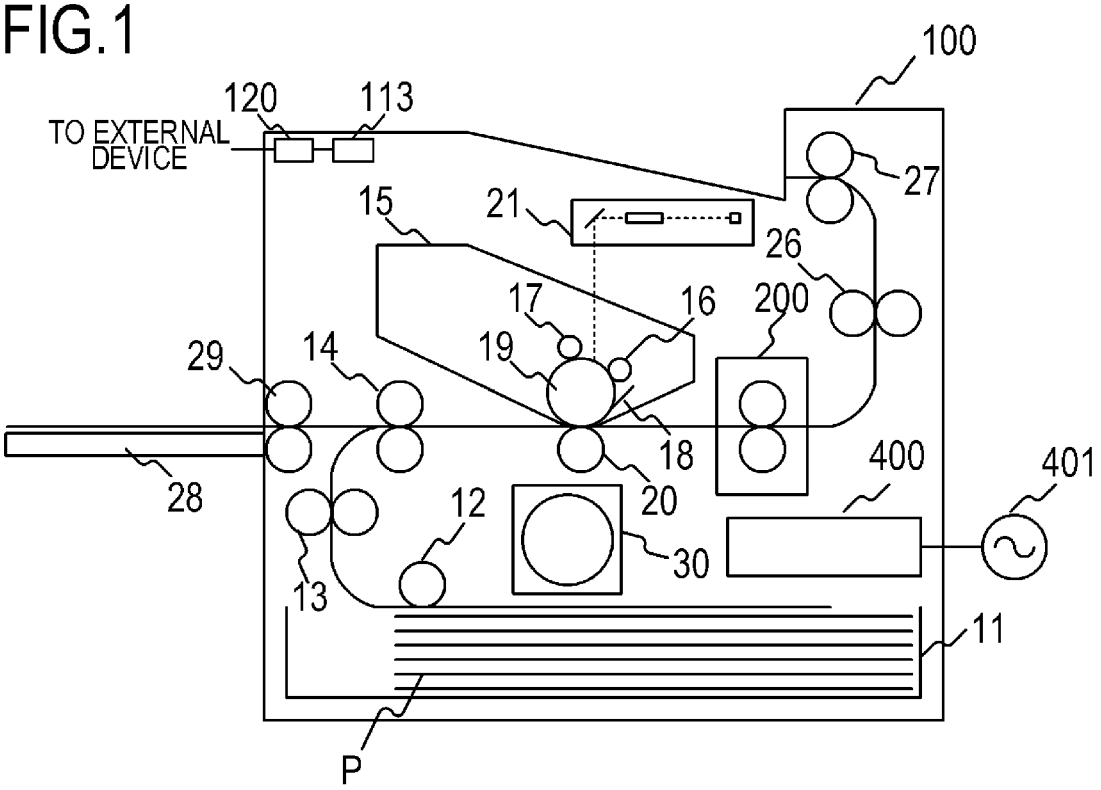
FIG. 1 is a cross-sectional view of an image forming apparatus according to an embodiment of the present invention.

FIG. 1 is a schematic sectional view of an image forming apparatus according to an embodiment of the present invention. Examples of image forming apparatus to which the present invention can be applied include a copying machine, a printer and the like using an electrophotographic method or an electrostatic recording method, and in the case explained herein, the present invention is applied to a laser printer in which an image is formed on a recording material P using an electrophotographic method.

An image forming apparatus 100 includes a video controller 120 and a control portion 113. The video controller 120 serves as an acquisition portion for acquiring information on an image to be formed on a recording material, and receives and processes image information and a print instruction transmitted from an external device such as a personal computer. The control portion 113 is connected to the video controller 120 and controls each portion constituting the image forming apparatus 100 according to instructions from the video controller 120. When the video controller 120 receives a print instruction from an external device, image formation is performed by the following operation.

Where a print signal is generated, a scanner unit 21 emits a laser beam modulated according to image information, and scans the surface of a photosensitive drum 19 charged to a predetermined polarity by a charging roller 16. As a result, an electrostatic latent image is formed on the photosensitive drum 19. By supplying toner from a developing roller 17 to the electrostatic latent image, the electrostatic latent image on the photosensitive drum 19 is developed as a toner image. Meanwhile, a recording material (recording paper) P stacked on a paper feed cassette 11 is fed one by one by a pickup roller 12, and is conveyed by a conveying roller pair 13 toward a registration roller pair 14. Further, the recording material P is conveyed from the registration roller pair 14 to a transfer position, which is formed by the photosensitive drum 19 and the transfer roller 20, at a timing when the toner image on the photosensitive drum 19 reaches the transfer position. As the recording material P passes through the transfer position, the toner image on the photosensitive drum 19 is transferred to the recording material P. Thereafter, the recording material P is heated by a fixing device (image heating device) 200 as a fixing portion (image heating portion), and the toner image is heated and fixed to the recording material P. The recording material P carrying the fixed toner image is discharged to a tray at the top of the image forming apparatus 100 by a pair of conveying rollers 26 and 27.

A drum cleaner 18 cleans the toner remaining on the photosensitive drum 19. A paper feed tray (manual tray) 28 having a pair of recording material regulating plates having a width that can be adjusted according to the size of the recording material P is provided to accommodate recording materials P other than the standard size. A pickup roller 29 feeds the recording material P from the paper feed tray 28. The image forming apparatus 100 has a motor 30 that drives the fixing device 200 and the like. A control circuit 400 as a heater driving means connected to a commercial AC power supply 401 controls electric power supply to the fixing device 200.

The photosensitive drum 19, the charging roller 16, the scanner unit 21, the developing roller 17, and the transfer roller 20 constitute an image forming portion that forms an unfixed image on the recording material P. In the present embodiment, a developing unit including the photosensitive drum 19, the charging roller 16, and the developing roller 17, and a cleaning unit including the drum cleaner 18 are configured to be detachable as a process cartridge 15 from the apparatus main body of the image forming apparatus 100.

In the image forming apparatus 100 of the present embodiment, the maximum paper passing width in the direction orthogonal to the conveyance direction of the recording material P is 216 mm, and plain paper of LTR size (216 mm×279 mm) is conveyed at a conveying speed of 232.5 mm/sec, thereby enabling printing at a rate of 44.3 prints per minute.

2. Configuration of Image Heating Device

Figure 2:
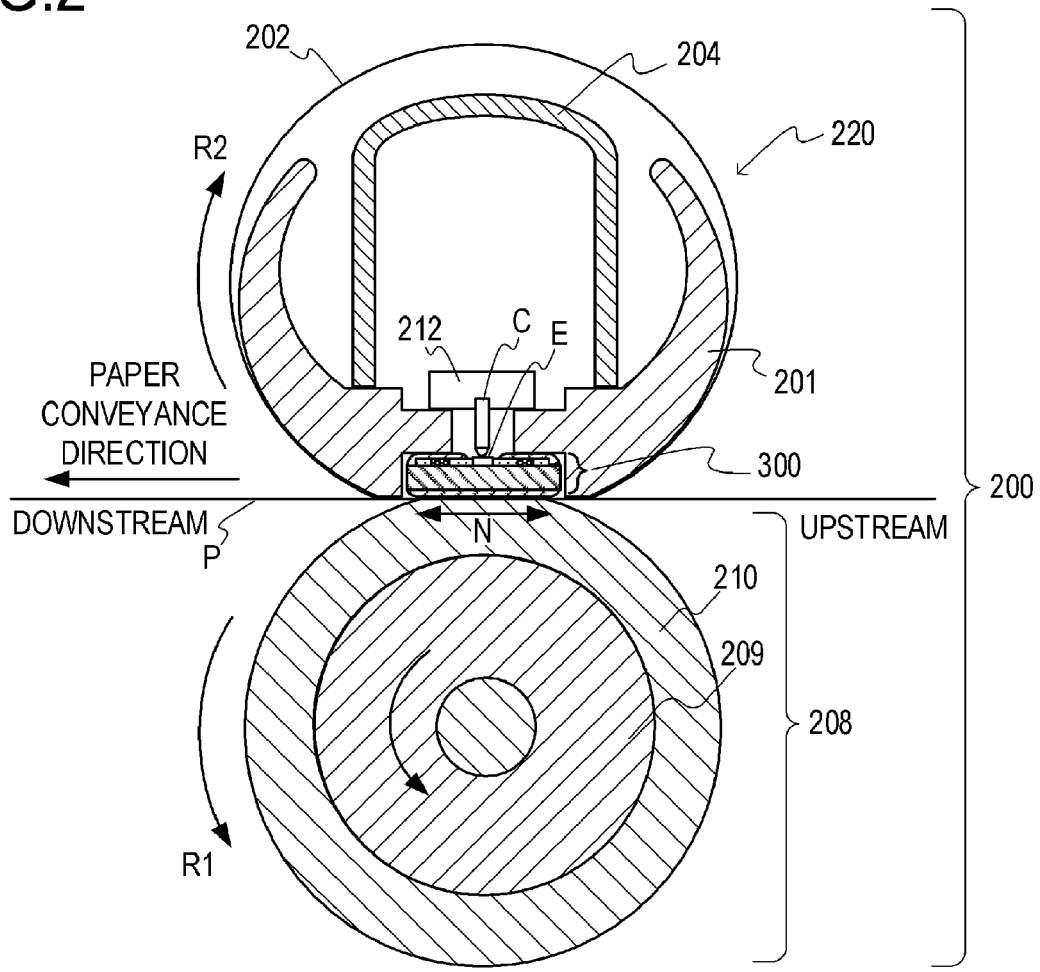
FIG. 2 is a cross-sectional view of an image heating device according to Embodiment 1.

FIG. 2 is a schematic sectional view of the fixing device 200 as an image heating device of the present embodiment. The fixing device 200 includes a fixing film 202 as an endless belt, a heater 300, a pressure roller 208 that forms a fixing nip portion N with the heater 300, with the fixing film 202 being interposed therebetween, and a metal stay 204.

The fixing film 202 is a multilayer heat-resistant film formed in a flexible tubular shape, and has a base layer of a heat-resistant resin such as a polyimide or a metal such as stainless steel. In order to prevent the toner from adhering and ensure the separation property from the recording material P, a release layer is formed on the surface of the fixing film 202 by coating a heat-resistant resin which has excellent releasability, such as tetrafluoroethylene-perfluoroalkylvinyl ether copolymer (PFA). Further, in an apparatus for forming a color image, an elastic layer of a heat-resistant rubber such as silicone rubber may be formed between the base layer and the release layer in order to improve image quality.

The pressure roller 208 has a core 209 made of a material such as iron or aluminum, and an elastic layer 210 made of a material such as silicone rubber. The heater 300 is held by a heater holding member 201 made of a heat-resistant resin, and heats the fixing film 202 by heating the heating regions $A_1$ to $A_7$ (described in detail hereinbelow) provided in the fixing nip portion N. The heater holding member 201 also has a guide function for guiding the rotation of the fixing film 202. The heater 300 is provided with electrodes E on the opposite side of the fixing nip portion N, and power is supplied to the electrodes E from electric contacts C. The metal stay 204 receives a pressing force (not shown) and urges the heater holding member 201 toward the pressure roller 208. Further, a safety element 212 such as a thermal switch or a temperature fuse that is actuated by abnormal heat generation of the heater 300 and shuts off power supplied to the heater 300 contacts the heater 300 directly or indirectly with the heater holding member 201 being interposed therebetween. A heating unit 220 being in contact with an inner surface of the fixing film 202 includes the heater 300, the heater holding member 201, and the metal stay 204.

The pressure roller 208 is driven by the motor 30 and rotates in the direction of an arrow R1. The fixing film 202 follows the rotation of the pressure roller 208 and rotates in the direction of an arrow R2. By applying heat to the fixing film 202 while nipping and conveying the recording material P in the fixing nip portion N, an unfixed toner image on the recording material P is subjected to a fixing process. Further, in order to ensure the slidability of the fixing film 202 and obtain a stable driven rotation state, grease (not shown) having high heat resistance is interposed between the heater 300 and the fixing film 202.

3. Configuration of Heater

Figure 3A:
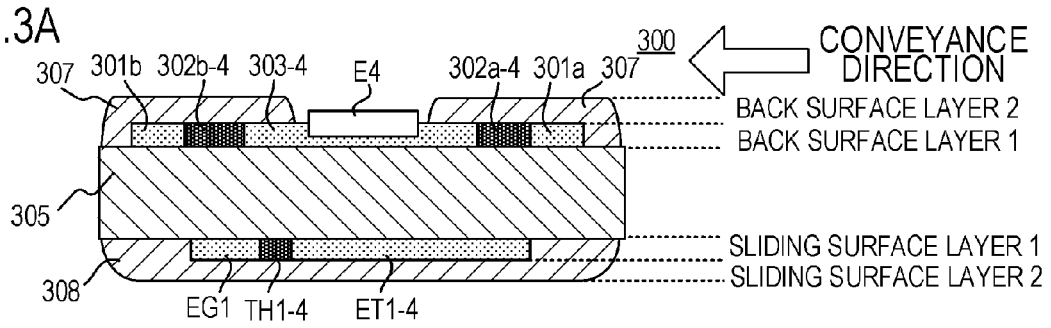
FIGS. 3A to 3C are heater configuration diagrams of Embodiment 1.

A configuration of the heater 300 according to the present embodiment will be described with reference to FIGS. 3A to 3C. FIG. 3A is a schematic cross-sectional view of the heater 300, FIG. 3B is a schematic plan view of each layer of the heater 300, and FIG. 3C is a schematic diagram illustrating a method for connecting the electric contact C to the heater 300.

Figure 3B:
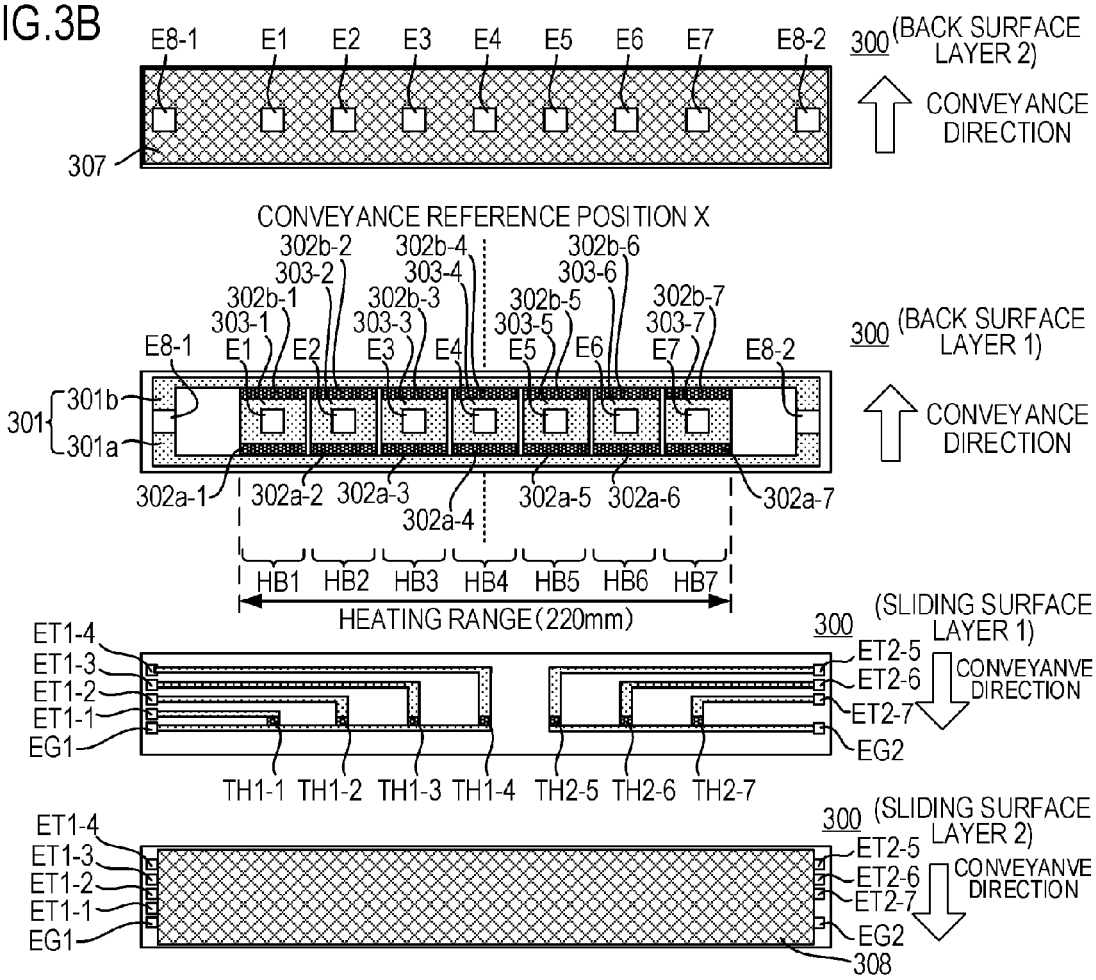
Figure 3C:
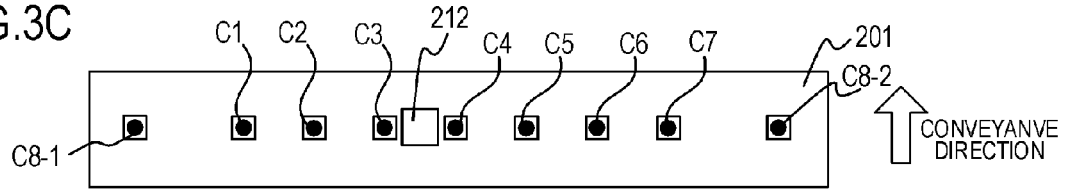

FIG. 3B shows a conveyance reference position X of the recording material P in the image forming apparatus 100 of the present embodiment. In the present embodiment, the conveyance reference is the center reference, and the recording material P is conveyed so that the center line in the direction orthogonal to the conveyance direction thereof is along the conveyance reference position X. FIG. 3A is a cross-sectional view of the heater 300 at the conveyance reference position X.

The heater 300 is configured of a substrate 305 made of a ceramic material, a back surface layer 1 provided on the substrate 305, a back surface layer 2 covering the back surface layer 1, a sliding surface layer 1 provided on the surface of the substrate 305 opposite to the back surface layer 1, and a sliding surface layer 2 covering the sliding surface layer 1.

The back surface layer 1 has conductors 301 (301*a* and 301*b*) provided along the longitudinal direction of the heater 300. The conductors 301 include a conductor 301*a* and a conductor 301*b* separated from each other, and the conductor 301*b* is disposed downstream of the conductor 301*a* in the conveyance direction of the recording material P.

Further, the back surface layer 1 has conductors 303 (303-1 to 303-7) provided in parallel with the conductors 301*a* and 301*b*. The conductors 303 are provided along the longitudinal direction of the heater 300 between the conductor 301*a* and the conductor 301*b*.

Furthermore, the back surface layer 1 also includes heating elements 302*a* (302*a*-1 to 302*a*-7) and heating elements 302*b* (302*b*-1 to 302*b*-7), which are heating resistance elements. The heating elements 302*a* are provided between the conductor 301*a* and the conductors 303, and generate heat when power is supplied through the conductor 301*a* and the conductors 303. The heating elements 302*b* are provided between the conductor 301*b* and the conductors 303, and generate heat when power is supplied through the conductor 301*b* and the conductors 303.

The heat generating portion composed of the conductors 301, the conductors 303, the heating elements 302*a*, and the heating elements 302*b* is divided into seven heating blocks (HB1 to HB7) in the longitudinal direction of the heater 300. That is, the heating element 302*a* is divided into seven regions of the heating elements 302*a*-1 to 302*a*-7 in the longitudinal direction of the heater 300. Further, the heating element 302*b* is divided into seven regions of heating elements 302*b*-1 to 302*b*-7 in the longitudinal direction of the heater 300. Furthermore, the conductors 303 are divided into seven regions of conductors 303-1 to 303-7 according to the division positions of the heating elements 302*a* and 302*b*.

The heat generation range of the present embodiment is a range from the left end of the heating block HB1 in the drawing to the right end of the heating block HB7 in the drawing, and the total length thereof is 220 mm. Further, the lengths of the heating blocks in the longitudinal direction are all the same, and are about 31.4 mm, but the lengths may be different.

The back surface layer 1 has electrodes E (E1 to E7, E8-1, and E8-2). The electrodes E1 to E7 are provided in the regions of the conductors 303-1 to 303-7, respectively, and are electrodes for supplying power to the heating blocks HB1 to HB7 via the conductors 303-1 to 303-7, respectively. The electrodes E8-1 and E8-2 are provided at the longitudinal ends of the heater 300 so as to be connected to the conductors 301, and serve for supplying power to the heating blocks HB1 to HB7 via the conductors 301. In the present embodiment, the electrodes E8-1 and E8-2 are provided at both longitudinal ends of the heater 300. However, for example, a configuration in which only the electrode E8-1 is provided on one side may be used. Further, although power is supplied to the conductors 301*a* and 301*b* by common electrodes, individual electrodes may be provided for each of the conductors 301*a* and 301*b* to supply power.

The back surface layer 2 is configured of a surface protection layer 307 having an insulating property (glass in the present embodiment), and covers the conductors 301, the conductors 303, and the heating elements 302*a* and 302*b*. The surface protection layer 307 is formed except for the location of the electrode E, and has a configuration in which an electrical contact C can be connected to the electrode E from the back surface layer 2 side of the heater.

The sliding surface layer 1 provided on the surface opposite to the back surface layer 1 on the substrate 305 is provided with thermistors TH (TH1-1 to TH1-4, and TH2-5 to TH2-7) for detecting the temperature of each of the heating blocks HB1 to HB7. The thermistors TH are made of a material having a PTC characteristic or an NTC characteristic (NTC characteristic in the present embodiment), and can detect the temperature of all the heating blocks, that is, the temperature of each of the plurality of heating regions for each heating region, by detecting the resistance value thereof.

The sliding surface layer 1 is also provided with conductors ET (ET1-1 to ET1-4 and ET2-5 to ET2-7) and conductors EG (EG1 and EG2) for applying an electric current to the thermistors TH and detecting the resistance value thereof. The conductors ET1-1 to ET1-4 are connected to the thermistors TH1-1 to TH1-4, respectively. The conductors ET2-5 to ET2-7 are connected to the thermistors TH2-5 to TH2-7, respectively. The conductor EG1 is connected to the four thermistors TH1-1 to TH1-4 and forms a common conductive path. The conductor EG2 is connected to the three thermistors TH2-5 to TH2-7 and forms a common conductive path. The conductor ET and the conductor EG are each formed to reach the longitudinal end along the length of the heater 300, and are connected to the control circuit 400 via an electric contact (not shown) at the longitudinal end of the heater.

The sliding surface layer 2 is configured of a surface protective layer 308 having a sliding property and an insulating property (in the present embodiment, glass). The sliding surface layer 2 covers the thermistors TH, the conductors ET, and the conductors EG and ensures slidability along the inner surface of the fixing film 202. The surface protective layer 308 is formed except for both longitudinal ends of the heater 300 in order to provide an electrical contact with the conductors ET and the conductors EG.

Next, a method of connecting the electric contact C to each electrode E will be described. FIG. 3C is a plan view showing a state where the electric contacts C are connected to the respective electrodes E, as viewed from the heater holding member 201 side. The heater holding member 201 is provided with through holes at positions corresponding to the electrodes E (E1 to E7, and E8-1, E8-2). At each through-hole position, the electrical contact C (C1 to C7, and C8-1, C8-2) is electrically connected to the electrode E (E1 to E7, and E8-1, E8-2) by a method such as urging with a spring or welding. The electric contacts C are connected to a control circuit 400 of the heater 300 described later via a conductive material (not shown) provided between the metal stay 204 and the heater holding member 201.

4. Configuration of Heater Control Circuit

Figure 4:
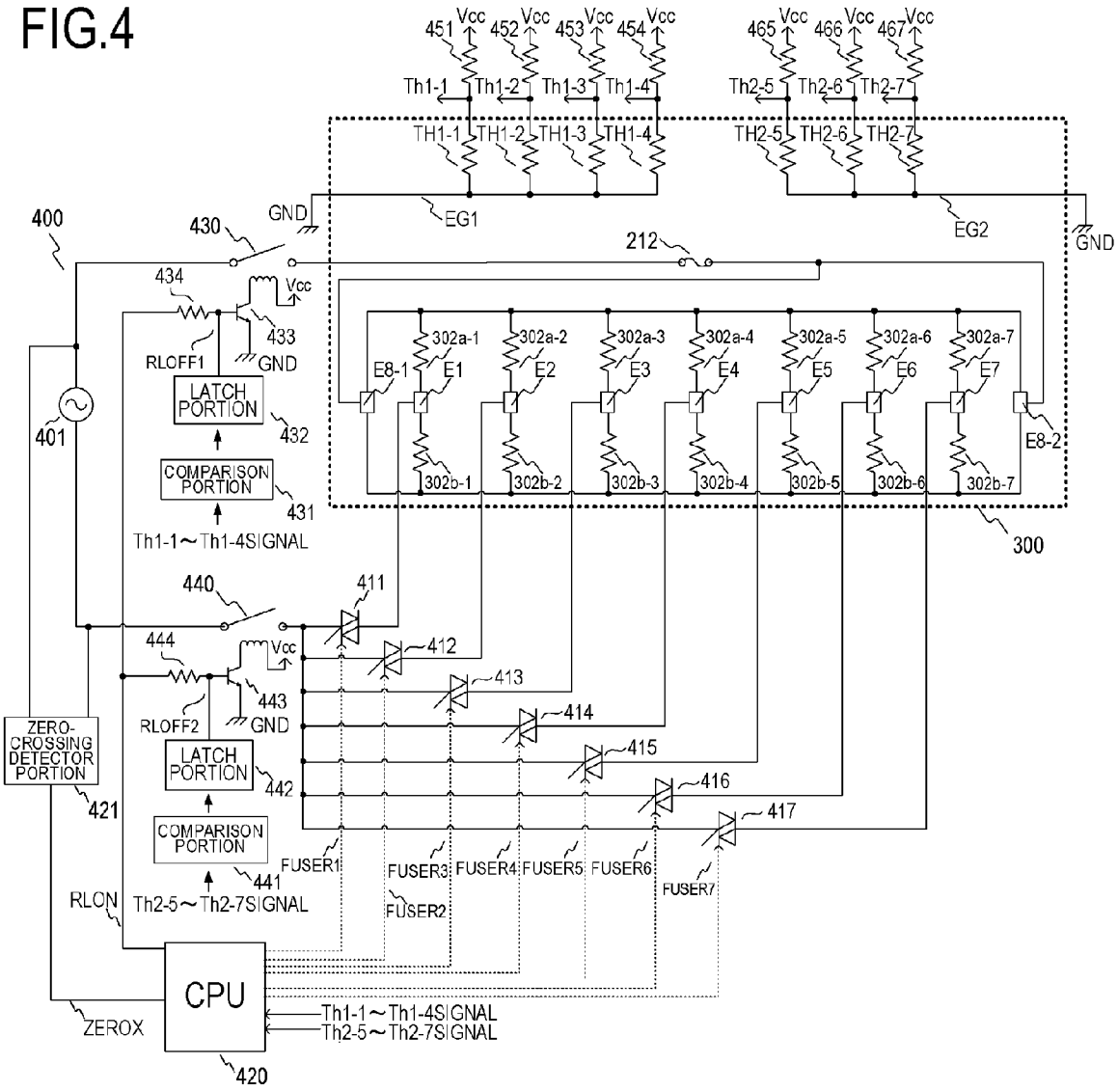
FIG. 4 is a heater control circuit diagram of Embodiment 1.

FIG. 4 is a circuit diagram of the control circuit 400 of the heater 300 of Embodiment 1. Reference numeral 401 denotes a commercial AC power supply connected to the image forming apparatus 100. The power control of the heater 300 is performed by turning on/off triacs 411 to 417. The triacs 411 to 417 operate according to FUSER1 to FUSER7 signals from the CPU 420, respectively. Drive circuits of the triacs 411 to 417 are not shown.

The control circuit 400 of the heater 300 has a circuit configuration enabling independent control of the seven heating blocks HB1 to HB7 by the seven triacs 411 to 417.

A zero-crossing detector 421 is a circuit that detects a zero-crossing of the AC power supply 401 and outputs a ZEROX signal to the CPU 420. The ZEROX signal is used for the timing detection of phase control or wave number control of the triacs 411 to 417, and the like.

Next, a method for detecting the temperature of the heater 300 will be described. The temperature of the heater 300 is detected by the thermistors TH (TH1-1 to TH1-4, TH2-5 to TH2-7). The divided voltage of the thermistors TH1-1 to TH1-4 and the resistors 451 to 454 is detected by the CPU 420 as Th1-1 to Th1-4 signals, and the CPU 420 converts the Th1-1 to Th1-4 signals to temperature. Similarly, the divided voltage of the thermistors TH2-5 to TH2-7 and the resistors 465 to 467 is detected by the CPU 420 as Th2-5 to Th2-7 signals, and the CPU 420 converts the Th2-5 to Th2-7 signals to temperature.

In the internal processing of the CPU 420, the power to be supplied is calculated by, for example, PI control (proportional-integral control) based on a control temperature $TGT_i$ of each heating block described later and the detected temperatures of the thermistors. Further, the power to be supplied is converted into a control level of phase angle (phase control) or a wave number (wave number control) corresponding to the power, and the triacs 411 to 417 are controlled based on the control conditions.

Relays 430 and 440 are used as power cutoff means for the heater 300 when the temperature of the heater 300 rises excessively due to a failure or the like.

The circuit operation of the relay 430 and the relay 440 will be described hereinbelow. Where an RLON signal becomes High, a transistor 433 is turned ON, an electric current flows to the secondary coil of the relay 430 from a power supply voltage Vcc, and the primary contact of the relay 430 is turned ON. Where the RLON signal becomes Low, the transistor 433 is turned OFF, the current flowing from the power supply voltage Vcc to the secondary coil of the relay 430 is cut off, and the primary contact of the relay 430 is turned OFF. Similarly, where the RLON signal becomes High, the transistor 443 is turned ON, an electric current flows to the secondary coil of the relay 440 from the power supply voltage Vcc, and the primary contact of the relay 440 turns ON. Where the RLON signal becomes Low, the transistor 443 is turned OFF, the current flowing from the power supply voltage Vcc to the secondary coil of the relay 440 is cut off, and the primary contact of the relay 440 is turned OFF. The resistor 434 and the resistor 444 are current limiting resistors that limit the base current of the transistors 433 and 443.

Next, the operation of the safety circuit using the relay 430 and the relay 440 will be described. Where any one of the temperatures detected by the thermistors TH1-1 to TH1-4 exceeds a respective predetermined value, a comparison portion 431 actuates a latch portion 432, and the latch portion 432 latches an RLOFF1 signal in a Low state. Where the RLOFF1 signal becomes Low, the transistor 433 is kept in the OFF state even when the CPU 420 puts the RLON signal High, so that the relay 430 can be kept in the OFF (safe state). In the non-latched state, the latch portion 432 outputs the RLOFF1 signal in the open state. Similarly, when any one of the temperatures detected by the thermistors TH2-5 to TH2-7 exceeds a respective predetermined value, a comparison portion 441 actuates a latch portion 442, and the latch portion 442 latches an RLOFF2 in a Low state. Where the RLOFF2 signal becomes Low, the transistor 443 is kept in the OFF state when the CPU 420 puts the RLON signal High, so that the relay 440 can be kept in the OFF state (safe state). Similarly, in the non-latched state, the latch portion 442 outputs the RLOFF2 signal in the open state.

5. Heating Regions

Figure 5:
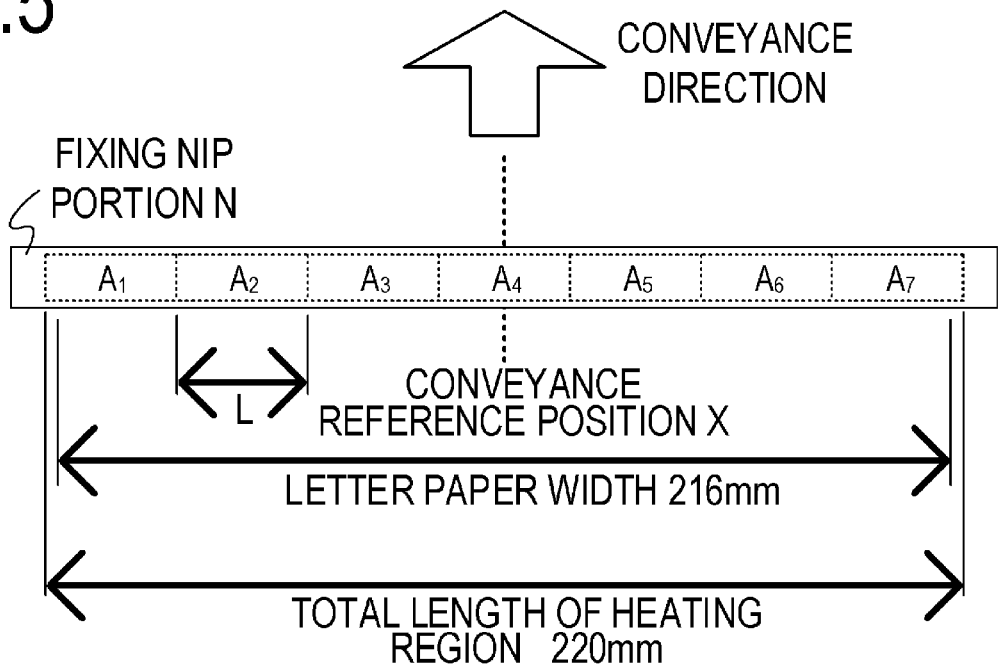
FIG. 5 is an explanatory diagram of heating regions of Embodiment 1.

FIG. 5 is a diagram showing the heating regions $A_1$ to $A_7$ in the present embodiment, which are displayed in comparison with the paper width of LTR size paper. The heating regions $A_1$ to $A_7$ are provided at positions corresponding to the heating blocks HB1 to HB7 in the fixing nip portion N, and the heating regions $A_i$ (i=1 to 7) are heated by the heat generated by the heating blocks $HB_i$ (i=1 to 7), respectively. The total length of the heating regions $A_1$ to $A_7$ is 220 mm, and the division into seven regions is performed so that the regions have the same length (L=31.4 mm).

Figure 7A:
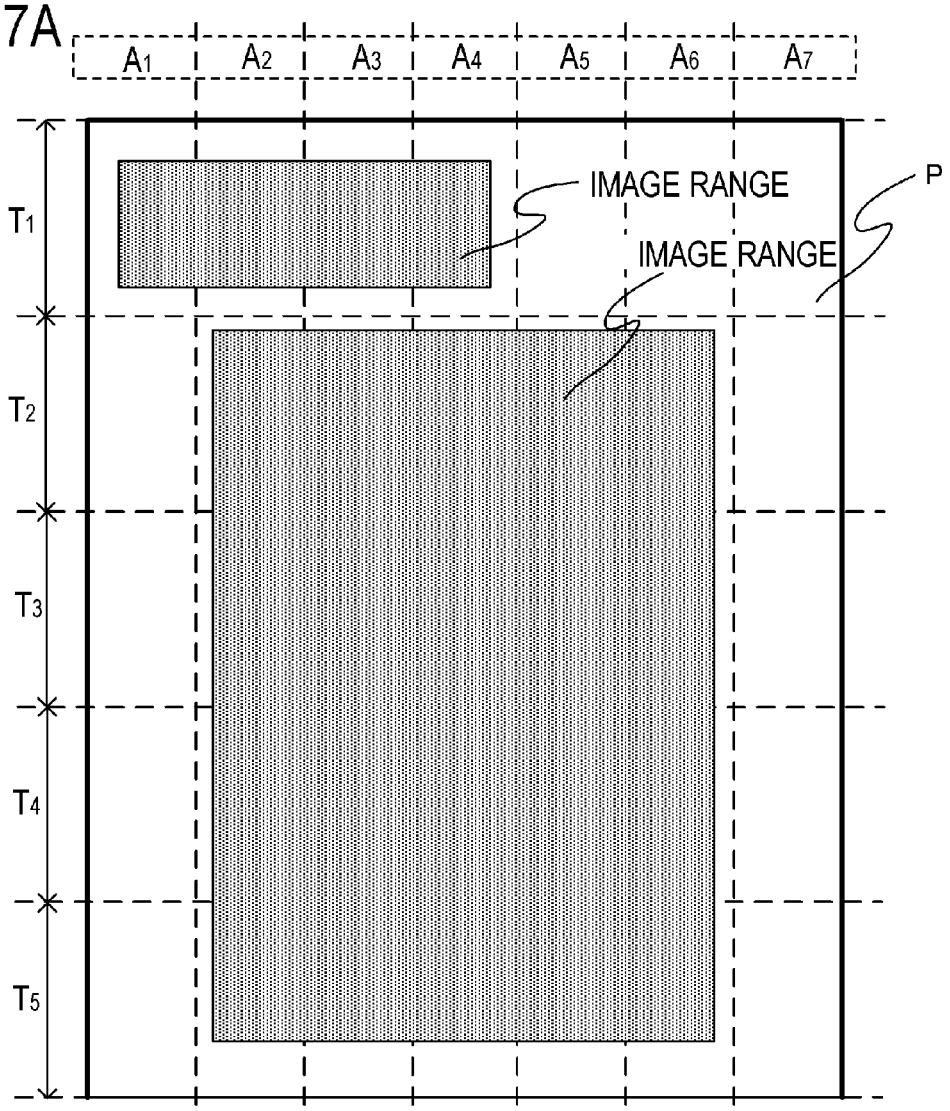

A specific example of classification of the heating regions $A_i$ will be described with reference to FIGS. 7A and 7B. In the present embodiment, the recording material P passing through the fixing nip portion N is sectioned at a predetermined time, and the heating region $A_i$ is classified for each section. In the present embodiment, sections are divided every 0.24 sec based on the leading end of the recording material P, and the division into sections is performed up to a section $T_5$, with the first section being a section $T_1$, the second section being a section $T_2$, and the third section being a section $T_3$.

In a specific example, the recording material P is LTR size, and passes from the heating region $A_1$ to the heating region $A_7$. Where the recording material and the image are present at the positions shown in FIG. 7A, the heating regions $A_i$ are classified as shown in the table of FIG. 7B.

In the image range, the heating region $A_i$ is classified as an image heating region AI, and outside the image range, the heating region $A_i$ is classified as a non-image heating region AP. The classification of the heating regions $A_i$ is used for controlling the heat generation amount of the heating blocks $HB_i$, as described hereinbelow.

Further, in the section $T_1$, from the image data (image information), the heating regions $A_1$, $A_2$, $A_3$, and $A_4$ pass through the image range and thus are classified as the image heating regions AI, and the heating regions $A_5$, $A_6$, and $A_7$ do not pass through the image range and thus are classified as the non-image heating regions AP. In sections T2 to T5, the heating regions $A_2$, $A_3$, $A_4$, $A_5$, and $A_6$ pass through the image range and thus are classified as the image heating regions AI, and the heating regions $A_1$ and $A_7$ do not pass through the image range and thus are classified as the non-image heating regions AP.

6. Overview of Heater Control Method

Next, a heater control method, that is, a heat generation amount control method of the heating blocks $HB_i$ (i=1 to 7), of the present embodiment will be described.

The heat generation amount of the heating block $HB_i$ is determined by the power supplied to the heating block $HB_i$. Increasing the power supplied to the heating block $HB_i$ increases the heat generation amount of the heating block $HB_i$, and decreasing the power supplied to the heating block $HB_i$ reduces the heat generation amount of the heating block $HB_i$.

The power supplied to the heating blocks $HB_i$ is calculated based on a control temperature $TGT_i$ (i=1 to 7) set for each heating block and the temperature detected by the thermistors. In the present embodiment, the supply power is calculated by PI control (proportional integral control) so that the detected temperature of each thermistor becomes equal to the control temperature $TGT_i$ of each heating block.

Figure 6:
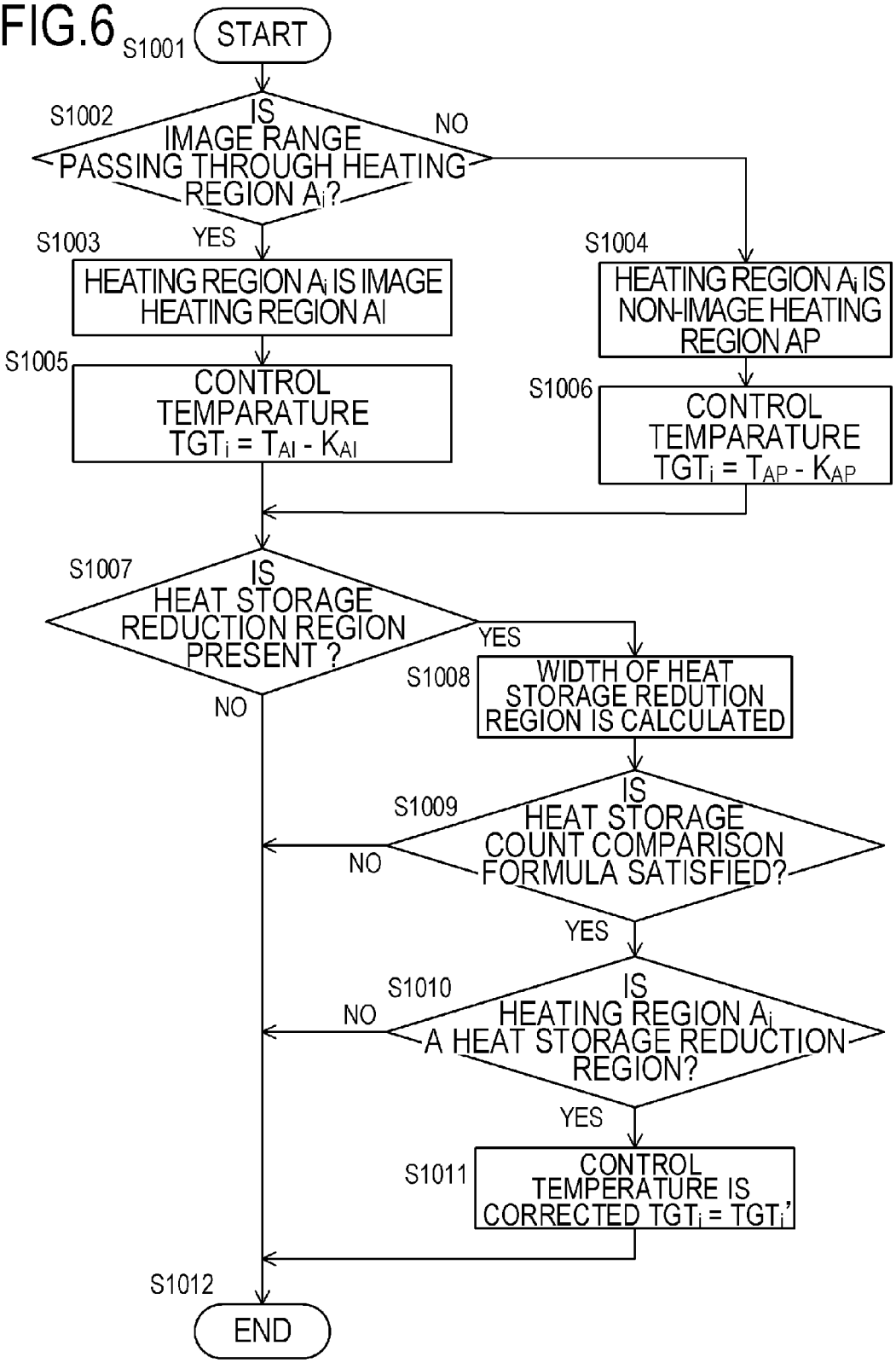
FIG. 6 is a flowchart for determining the classification of heating regions and the control temperature in Embodiment 1.

The control temperature $TGT_i$ of each heating block is set according to the classification of the heating regions $A_i$ determined according to the flow of FIG. 6.

7. Method for Determining Heat Storage Amount

As described above, with respect to each of the heating regions $A_1$ to $A_7$, correction is performed in accordance with the heat storage amount of each heating region, and the control temperature TGT (details will be described hereinbelow) as the heating amount which is the control target temperature when the recording material P is actually heated is determined.

A method for determining the heat storage amount in the present embodiment will be described hereinbelow. First, in the present embodiment, a heat storage counter representing the heat history for each of the heating regions $A_1$ to $A_7$ is provided. Where the value of the heat storage counter is taken as CT, the heat storage counter value CT indicates how much each of the heating regions has been heated, how much heat has been dissipated, the heating history, and heat dissipation history thereof (details will be described hereinbelow).

In Embodiment 1, the heat storage count value CT is obtained for each page (immediately after the printing of the page is executed), and for the next page, a control temperature TGT, which is a temperature when the image heating region AI of the recording material P is actually heated, is determined according to this value.

The heat storage count value CT will be described in detail hereinbelow. A method for determining the heat storage count value CT indicating the heating history and heat dissipation history of each heating region will be described. The heat storage counter for each heating region counts the heat history by a prescribed method according to the heating operation for the heating region and the paper passing state of the recording material. The count value CT of the heat storage counter is represented by a following (Formula 1).

$$CT=(TC\times HLC)+(WUC+INC+PC)-(RMC\times PLC+\mathrm{DC}) \quad \text{(Formula 1)}$$

Here, CT is a heating count, HLC is an image distance count, WCU is a rise-up count, INC is a paper interval count, PC is a post-rotation count, RMC is a recording material passing count, PLC is a paper passing distance count, and DC is heat dissipation count. FIGS. 8A to 8D show the set values.

(TC×HLC) and (WUC+INC+PC) as the heating history in (Formula 1) are the heating history, and (RMC×PLC+DC) is the heat dissipation history. It is assumed that the heat storage count value CT in the present embodiment is updated every page (immediately after the printing of the page is executed).

As shown in FIG. 8A, the heating count TC is a value determined according to the control target temperature TGT when heating the recording material, and this value increases as the control target temperature TGT rises.

As shown in FIG. 8B, the image distance count HLC is a value determined according to the distance HL (mm) in the conveyance direction in which the recording material has been heated, and this value increases as the HL increases.

In the heating region, (TC×HLC) for the image heating region AI and the non-image heating region AP outside thereof are added to make one page.

Other counts, that is, the rise-up count WUC, the paper interval count INC, and the post-rotation count PC are fixed values counted for the rise-up at the start of printing, the paper interval, and the post-rotation at the end of printing, as shown in FIG. 8D. For example, when the rise-up time, the paper interval, and the post-rotation time change according to the operating conditions, the WUC, INC, and PC can be changed accordingly. The parameters indicating the heating history are not limited to those indicated hereinabove, and another parameter indicating the temperature history of the heater or the history of power supplied to the heating elements may be used.

Further, as shown in FIG. 8D, the recording material passing count RMC and the heat dissipation count DC are fixed values counted for the heat taken from the image heating device when the recording material P passes thereby and for the heat dissipation to the outside air. As shown in FIG. 8C, the paper passing distance count PLC is a value determined according to the distance PL (mm) in the conveyance direction in which the recording material P has passed, and this value increases as PL increases.

These RMC and DC can be changed to values corresponding to the type of recording material and environmental conditions. The heat dissipation count DC is also counted not during printing, and a specified value is counted after a specified time has elapsed (for example, three counts up per minute). Further, the parameter representing the heat radiation history is not limited to the above, and another parameter indicating the passage history of the recording material in the heating region or the period during which power is not supplied to the heating element may be used.

In the present embodiment, a more appropriate control temperature TGT is obtained using the heat storage count value $CT_i$ determined in this way for correcting the control temperature for the heating regions.

FIG. 8E shows the relationship between the heat storage count value $CT_i$ and the correction values $K_{AI}$ and $K_{AP}$ for the control temperature TGT.

$K_{AI}$ is an image heating region temperature correction term, and $K_{AP}$ is a non-image heating region temperature correction term, and these are set according to the heat storage count value $CT_i$ in each heating region $A_i$ as shown in FIG. 8E.

The relationship between the heat storage count value $CT_i$ and the correction values $K_{AI}$ and $K_{AP}$ for the control temperature $TGT_i$ is determined in advance from the results obtained in checking the heat storage state and the image characteristics after fixing by the image heating device of Embodiment 1.

8. Method for Setting Control Target Temperature

FIG. 6 is a flowchart for determining the classification of heating regions and the control temperature in the present embodiment. The control portion 113 is the main portion for controlling the flow.

Each heating region $A_i$ (i=1 to 7) is classified into the image heating region AI or the non-image heating region AP as shown in the flowchart of FIG. 6.

The classification of the heating regions $A_i$ is performed based on image data (image information) and recording material information (recording material size) sent from an external device (not shown) such as a host computer. That is, whether the heating region $A_i$ is the image range is determined from the image data (image information) (S1002). Where the heating region is the image range, the heating region $A_i$ is classified as the image heating region AI (S1003), and where the heating region is not the image range, the heating region $A_i$ is classified as the non-image heating region AP (S1004). The classification of the heating region $A_i$ is used for controlling the heat generation amount of the heating blocks $HB_i$, as described hereinbelow.

Where the heating region is classified as the image heating region AI, the control temperature $TGT_i$ is set as $TGT_i=T_{AI}-K_{AI}$ (S1005).

Here, $T_{AI}$ is an image heating region reference temperature, and is set as an appropriate temperature for fixing an unfixed image to the recording material P. Where the plain paper is passed in the fixing device 200 of the present embodiment, $T_{AI}$ is set to 205° C. It is desirable that the image heating reference temperature $T_{AI}$ be variable according to the type of the recording material P such as thick paper or thin paper. Further, the image heating region reference temperature $T_{AI}$ may be adjusted according to image information such as image density and pixel density.

$K_{AI}$ is an image heating region temperature correction term, and is set according to the heat storage count value $CT_i$ in each heating region $A_i$ as shown in FIG. 8E. Here, the heat storage count value $CT_i$ is a parameter correlated with the heat storage amount of the fixing device 200 in each heating region $A_i$ and indicates that the larger the heat storage count value $CT_i$, the larger the heat storage amount. The amount of heat for fixing the toner image on the recording material P is given by the heat generation amount of the heating block $HB_i$ and the heat storage amount in the heating region $A_i$. That is, with the larger heat storage amount in the heating region $A_i$, the toner image can be fixed on the recording material P even with a smaller heat generation amount of the heat generation block $HB_i$. Therefore, in the image forming apparatus 100 of the present embodiment, the value of the image heating region temperature correction term $K_{AI}$ is set to increase as the heat storage amount (heat storage count value $CT_i$) increases, the control temperature $TGT_i$ is lowered, and the heat generation amount of the heat generation block $HB_i$ is reduced. This prevents an excessive amount of heat from being applied to the toner image when the heat storage amount in the heating region $A_i$ is large, thereby achieving power saving.

Next, the case where the heating region $A_i$ is classified as the non-image heating region AP (S1004) will be described. Where the heating region $A_i$ is classified as the non-image heating region AP, the control temperature $TGT_i$ is set as $TGT_i=T_{AP}-K_{AP}$ (S1006).

Here, $T_{AP}$ is a non-image heating region reference temperature, and is set to be lower than the image heating reference temperature $T_{AI}$, thereby lowering the heat generation amount of the heating block $HB_i$ in the non-image heating region AP with respect to that in the image heating region AI and saving the power of the image forming apparatus 100. However, where the non-image heating region reference temperature $T_{AP}$ is lowered too much, when the heating region $A_i$ is switched from the non-image heating region AP to the image heating region AI, it may not be possible to sufficiently heat the heating block $HB_i$ to the control temperature of the image portion even when the maximum power that can be applied is applied to the heating block. In this case, there is a possibility that the phenomenon that the toner image is not sufficiently fixed on the recording material (fixing failure) may occur. Therefore, it is necessary to set the non-image heating region reference temperature $T_{AP}$ to an appropriate value. According to the tests performed by the inventors, it has been found that in the image forming apparatus 100 of the present embodiment, it is preferable that the non-image heating region reference temperature $T_{AP}$ be set within 100° C. from the image heating region reference temperature $T_{AI}$=205° C. As a result of fitting within the range of such temperature difference, no fixing failure occurs when switching from the non-image heating region AP to the image heating region AI. Therefore, from the viewpoint of power saving, it is desirable that the non-image heating region reference temperature $T_{AP}$ be such that the control temperature $TGT_i$ be lowered as much as possible and the heat generation amount of the heating block $HB_i$ be reduced. Therefore, in the present embodiment, the non-image heating region reference temperature $T_{AP}$ is set to 105° C.

It is desirable that the non-image heating reference temperature $T_{AP}$ be variable according to the type of the recording material P such as thick paper or thin paper.

Further, $K_{AP}$ is a non-image heating region temperature correction term, and as shown in FIG. 8E, the non-image heating region temperature correction term $K_{AP}$ is set to increase as the heat storage count value $CT_i$ in each heating region $A_i$ increases, that is, as the heat storage amount in each heating region $A_i$ increases. Here, when the heating region $A_i$ is switched from the non-image heating region AP to the image heating region AI, the amount of heat required to cause the temperature of the heater 300 to reach the control temperature of the image portion is provided by the heat generation amount of the heating block $HB_i$ and the heat storage amount in the region $A_i$. That is, when the maximum power that can be supplied is supplied to the heating block $HB_i$ (when the supplied power is constant), the control temperature of the image portion can be reached quicker with a larger heat storage amount in the heating region $A_i$. The fact that it is possible to quickly reach the control temperature of the image portion means that even if the control temperature $TGT_i$ of the non-image heating region AP is lowered, it is possible to perform sufficient heating to the control temperature of the image portion, and the occurrence of a fixing failure can be prevented. Therefore, in the image forming apparatus 100 of the present embodiment, the value of the non-image heating region temperature correction term $K_{AP}$ is set to increase as the heat storage amount (heat storage count value $CT_i$) increases, the control temperature $TGT_i$ is lowered, and the heat generation amount of the heat generation block $HB_i$ is reduced. This prevents an excessive amount of heat from being applied to the fixing device 200 when the heat storage amount in the heating region $A_i$ is large, thereby achieving power saving.

Next, (S1007) will be described. In S1007, the heat storage count values of the heating regions are compared to determine whether there is a heat storage reduction region. First, a region having a maximum heat storage amount (heat storage count value) among the heating regions is defined as a heat storage maximum region, and a region having a smaller heat storage amount (heat storage count value) than the heat storage amount maximum region is defined as a heat storage reduction region.

A specific print example will be described with reference to FIGS. 9A-a to 9A-e and 9B-f to 9B-h.

FIGS. 9A-a to 9A-e and 9B-f to 9B-h show the state of the image region on the recording material and the heat storage count value used in the paper passing conditions 1 to 4. FIG. 9A-a is an image under the paper passing condition 1, the image being arranged in the range of the heating region $A_4$ of the recording material (LTR size: paper width 216 mm, paper length 279 mm, basis weight 75 g/cm$^2$). Similarly, FIG. 9A-c is an image under the paper passing condition 2, the image being arranged in the range of the heating regions $A_3$, $A_4$, and $A_5$. FIG. 9B-e is an image under the paper passing condition 3, the image being arranged in the heating regions $A_2$, $A_3$, $A_4$, $A_5$, and $A_6$. FIG. 9B-g is an image under the paper passing condition 4, the image being arranged in the heating regions $A_1$, $A_2$, $A_3$, $A_4$, $A_5$, $A_6$, and $A_7$.

Further, FIGS. 9A-b, 9A-d, 9B-f, and 9B-h show the states of the heat storage count in the case of feeding continuously the recording material on which the images of the paper passing conditions from 1 to 4 have been arranged. Since the heating region $A_4$ is an image region under the paper passing condition 1 in FIG. 9A-a, the control temperature corresponds to the image heating region. Meanwhile, the heating regions $A_1$, $A_2$, $A_3$, $A_5$, $A_6$, and $A_7$ are non-image regions, and the control temperature is set to a value lower than the control temperature for the image region. Therefore, the heat storage state (heat storage count) of the heating regions $A_1$, $A_2$, $A_3$, $A_5$, $A_6$, and $A_7$ is smaller than that of the heating region $A_4$.

In this case, the heating region $A_4$ is the heat storage maximum region. Further, since the heat storage count values of the heating regions $A_1$, $A_2$, $A_3$, $A_5$, $A_6$, and $A_7$ are smaller than that of the heat storage maximum region, these regions are heat storage reduction regions. Further, since the heat storage reduction regions are located on both sides in the longitudinal direction of the heat storage maximum region under the present paper passing condition, the heating regions $A_1$, $A_2$, and $A_3$, which are on the left side in the longitudinal direction in the figure, are defined as heat storage reduction regions L, and the heating regions $A_5$, $A_6$, and $A_7$, which are on the right side in the longitudinal direction, are defined as heat storage reduction regions R.

Similarly, in the paper passing condition 2 of FIG. 9A-c, the heating regions $A_1$ and $A_2$ are defined as the heat storage reduction regions L, $A_6$ and $A_7$ are defined as the heat storage reduction regions R, and in the paper passing condition 3 of FIG. 9B-e, the heating region $A_1$ is defined as the heat storage reduction region L, and $A_7$ is defined as the heat storage reduction region R.

Next, where a heat storage reduction region is present in S1007, the processing advances to S1008 to calculate the width LCW of the heat storage reduction region.

Meanwhile, in the case of the paper passing condition 4 shown in FIG. 9B-g, the heat storage count value is uniform in the longitudinal direction, and there is no heat storage reduction region. In this case, the temperature control is performed by the control temperature determined in S1005.

The calculation of the width LCW of the heat storage reduction region when the processing advanced to S1008 is described hereinbelow. In the paper passing condition 3, the heat storage reduction region L is the heating region $A_1$, and since only one heating region is individually present, the width LCW of the heat storage reduction region is 31.4 mm corresponding to the heating element width of the heating region $A_1$. Likewise, on the opposite side in the longitudinal direction, the width of the heat storage reduction region R is also 31.4 mm corresponding to the heating element width of the heating region $A_7$. Since the heating regions $A_1$ and $A_2$ are present adjacent to each other in the heat storage reduction region L in the paper passing condition 2, the width LCW of the heat storage reduction region is 62.8 mm corresponding to the sum of the heating element widths of the heating regions $A_1$ and $A_2$. Likewise, on the opposite side in the longitudinal direction, the width of the heat storage reduction region R is also 62.8 mm Since the heating regions $A_1$, $A_2$ and $A_3$ are present adjacent to each other in the heat storage reduction region L in the paper passing condition 1, the width LCW of the heat storage reduction region is 94.2 mm corresponding to the sum of the heating element widths of the heating regions $A_1$, $A_2$ and $A_3$. Likewise, on the opposite side in the longitudinal direction, the width of the heat storage reduction region R is also 94.2 mm Next, in S1009, it is determined whether the heat storage count value satisfies the following heat storage count comparison formulas.

$$CT_{max}-CTL>Y \quad \text{(Formula 2)}$$

$$CT_{max}-CTR>Y \quad \text{(Formula 3)}$$

Here, $CT_{max}$ is the heat storage count value of the heat storage maximum region (heat storage maximum count value), CTL is the minimum value of the heat storage count value of the heat storage reduction region L (heat storage reduction count value), and CTR is the minimum value of the heat storage count value of the heat storage reduction region R (heat storage reduction count value). Y is a deviation determination value.

The deviation determination value Y is determined from the heat storage reduction region width LCW as shown in Table 1. The heat storage reduction region width LCW is the heat storage reduction region width calculated in S1008.

TABLE 1

| Heat storage reduction region width LCW | Determination value Y |
|---|---|
| 31.4 mm | 300 |
| 62.8 mm | 200 |
| 94.2 mm | 100 |

Next, S1009 will be described in detail. In S1009, it is determined whether or not the fixing film is receiving a deviation force of a predetermined amount or more in the direction of the heat storage maximum region. As described above, the heat storage count value CT is a parameter correlated with the heat storage amount of the member of the image heating device. Therefore, the larger the heat storage count value CT, the larger the heat storage amount and the larger the outer diameter of the pressure roller, which is a member of the image heating device. The heat storage count value CT is also a parameter correlated with the outer diameter of the pressure roller.

When images as under the paper passing conditions 1 to 3 are continuously printed, the difference between the maximum heat storage count value $CT_{max}$ and the heat storage reduction region count values $CT_L$ and $CT_R$ increases, and the outer diameter difference of the pressure roller also increases accordingly. Therefore, the deviation force acting on the fixing film in the direction from the heat storage reduction region where the outer diameter of the pressure roller is small to the heat storage maximum region where the outer diameter of the pressure roller is large increases.

Here, the present inventors have found that where the difference between the heat storage amounts of the heat storage maximum region and the heat storage reduction region is equal to or more than the film deviation determination value, the fixing film exceeds the film fracture limit due to the increase in the deviation force from the heat storage reduction region to the heat storage maximum region, and wrinkles occur in the center of the film, causing damage. It has also been found that this film deviation determination value is correlated with the heat storage reduction region width LCW.

Figure 10:
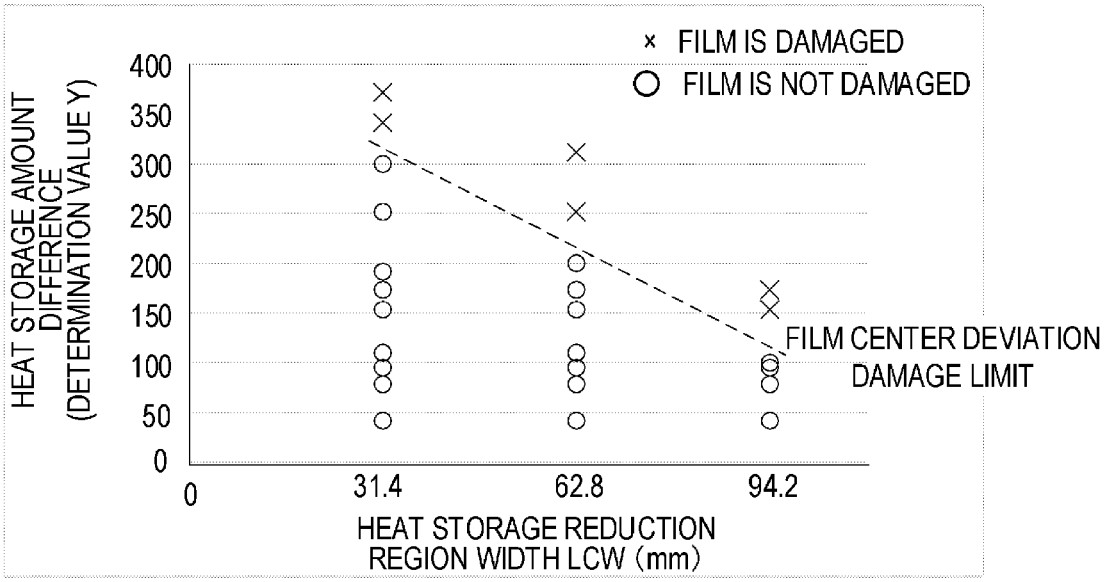
FIG. 10 is a diagram illustrating a specific example in Embodiment 1.

FIG. 10 is a graph showing the relationship between the heat storage reduction region width LCW, the difference between the heat storage amount of the heat storage maximum region and the heat storage amount of the heat storage reduction region (determination value), and the film damage.

When the heat storage reduction region is a single region of 31.4 mm as under the paper passing condition 1, where the difference in heat storage amount between the heat storage maximum region and the heat storage reduction region is 300 or less, the film is not damaged. Meanwhile, when the heat storage reduction region is a plurality of regions and is 62.8 mm as under the paper passing condition 2, where the difference in heat storage amount between the heat storage maximum region and the heat storage reduction region is 200 or less, the film is not damaged. Further, where the heat storage reduction region is 94.2 mm as under the paper passing condition 3, where the difference in heat storage amount between the heat storage maximum region and the heat storage reduction region is 100 or less, the film is not damaged. Where the aforementioned difference in the heat storage amount is exceeded, the film may be damaged.

As described above, it was found that the larger the heat storage reduction region width LCW, the greater the deviation force in the direction of the heat storage maximum region, and the film is damaged at a small difference in the heat storage amount.

Therefore, the film center deviation determination value Y in the present embodiment is set by the heat storage reduction region width LCW as shown in Table 1, and it is determined whether or not the film is damaged by the heat storage count comparison formulas (Formula 2) and (Formula 3).

When (Formula 2) and (Formula 3) are satisfied in S1009, the processing advances to S1010, and where the heating region $A_i$ is the heat storage reduction region, the control temperature $TGT_i'$ is set so that no film damage occurs due to the film deviation.

Here, the control temperature $TGT_i$ is set to $TGT_i'=T_{AI}-K_{AI}$ irrespective of whether or not the image range passes through the heat storage reduction region (S1011).

$T_{AI}$ is an image heating region reference temperature, and $K_{AI}$ is an image heating region temperature correction term, and these are the same as those set in S1005.

Due to the control temperature correction in S1011, even when the image does not pass through the heat storage reduction region as in the image patterns shown in FIGS. 9A-a to 9A-d and 9B-e to 9B-h, the increase in the difference in heat storage count value can be suppressed and maintained within a predetermined range by performing heating at the same level as in the image heating region.

Therefore, the film deviation force acting from the heat storage reduction region to the heat storage maximum region can be maintained in a predetermined range without increasing and exceeding the fracture limit. Therefore, damage to the fixing film can be suppressed.

As described above, in the present embodiment, the control temperature $TGT_i$ for each heating region $A_i$ is determined according to the classification of the heating region $A_i$ and the heat storage count value $CT_i$. The set values of each heating region reference temperature ($T_{AI}$·$T_{AP}$), each heating region temperature correction term ($K_{AI}$·$K_{AP}$), and the deviation determination value Y need to be determined, as appropriate, by taking into account the configuration and printing conditions of the image forming apparatus 100 and the fixing device 200. That is, the above-described values are not limiting.

9. Effects of the Present Embodiment

Figure 21:
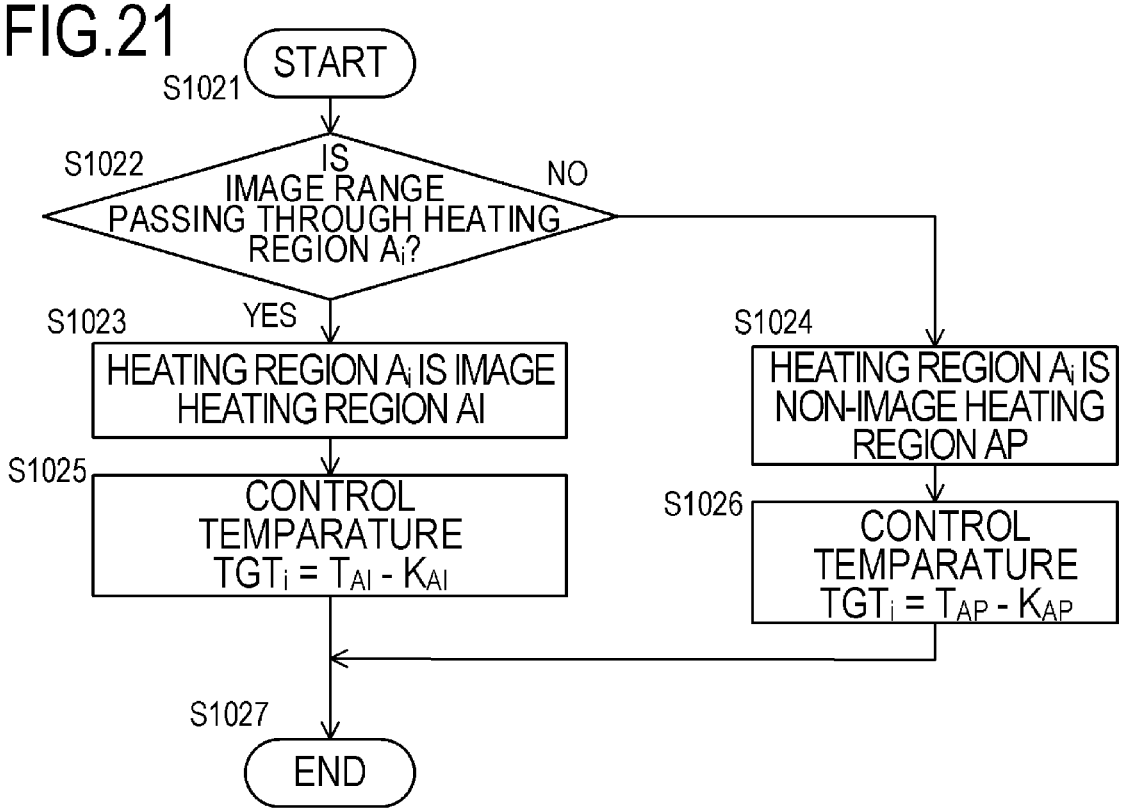
FIG. 21 is a flowchart for determining the classification of heating regions and the control temperature in a comparative example.

For comparison, a heater control method using a conventional technique will be described as a comparative example. FIG. 21 shows a control flow of the comparative example. In the comparative example, the control temperatures $TGT_i$ of the image heating region AI and the non-image heating region AP are set to be the same as those in Embodiment 1.

Next, the effects of the present embodiment will be described with reference to a specific example of Embodiment 1 shown below as a specific print example. In the specific example of Embodiment 1, continuous printing on the recording material was performed using images of the paper passing conditions from 1 to 3 shown in FIGS. 9A-a to 9A-d and 9B-e to 9B-h from the room temperature state of the fixing device 200, that is, from the state where the heat storage count value $CT_i$ of each heating region $A_i$ is 0. The recording material used was LTR size: paper width 216 mm, paper length 279 mm, and basis weight 75 g/m$^2$.

FIGS. 11A, 12A, and 13A show how the heat storage count value $CT_i$ of the heating region $A_i$ changes with respect to the of paper passing number of the recording material under each paper passing condition. FIGS. 11B, 12B, and 13B show the control temperature, the heat storage count value, the difference in heat storage count values, and the presence or absence of damage due to the center deviation of the fixing film depending on the paper passing number.

The solid line represents the transition of the heat storage count value CT of the heating region which is an image region and a heat storage maximum region in Embodiment 1.

The two-dot chain line represents the transition of the heat storage count value CT of the heating region classified as a heat storage reduction region and a non-image region in Embodiment 1. Further, for comparison, the transition of the heat storage count value CT of the non-image region and the heat storage reduction region in the comparative example is indicated by a broken line.

The calculation of the heat storage count in the heating region in the comparative example reflects the same transition as in Embodiment 1, and therefore the description is omitted.

In the printing of an image under the paper passing condition 1, as shown in FIG. 11A, in the heating region ($A_4$) which is the heat storage maximum region, the heat storage count value $CT_4$ increases as the number of prints increases. Since the heating region ($A_4$) is classified into the image heating region AI, the control temperature TGT for the first print is set to 205° C., the heat storage count value $CT_4$ increases with the paper passing, and the heat storage count value for the 27th print reaches 114.7.

Further, in the heating regions ($A_1$, $A_2$, $A_3$, $A_5$, $A_6$, and $A_7$) which are the heat storage reduction regions, since the regions are classified into the non-image heating regions AP, the non-image heating region temperature $T_{AP}$ for the first print is set to 105° C. Therefore, as the number of prints increases, the heat storage count value ($CT_1$, $CT_2$, $CT_3$, $CT_5$, $CT_6$, and $CT_7$) increases, but does not increase more than the heat storage count value $CT_4$ because the heat generation amount of the heating block is reduced. The heat storage count value of the 27th print is 13.3.

In the image under the paper passing condition 1, as described above, the width LCW of the heat storage reduction region in this case is 94.2 mm corresponding to the sum of the widths of the heating elements of the heating regions $A_1$, $A_2$, and $A_3$. Similarly, the width of the heat storage reduction region R on the opposite side in the longitudinal direction is 94.2 mm. The deviation determination value Y is set to 100 from Table 1. Therefore, the conditions of (Formula 2) and (Formula 3) described above are satisfied for the 27th print. Therefore, in the heating regions ($A_1$, $A_2$, $A_3$, $A_5$, $A_6$, and $A_7$) which are the heat storage reduction regions in the 28th print, the control temperature $TGT_i'$ is corrected and set as $TGT_i'=T_{AI}-K_{AI}$ by S1011 of the control flow shown in FIG. 6 so as to prevent the occurrence of film damage caused by deviation. $T_{AI}$ is the image heating region reference temperature of 205° C.

As shown by the two-dot chain line in FIG. 11A, the increase in the heat storage count value after the 28th print in the heat storage reduction region in the present embodiment is substantially the same as in the heat storage count value $CT_4$ in the image region that is the heat storage maximum region. Therefore, as shown in FIG. 11B, the difference in the heat storage count amount between the heat storage reduction region and the heat storage maximum region is maintained at about 100, and does not become larger than a certain value. Therefore, no film damage occurs.

Meanwhile, in the control of the comparative example, as shown by the broken line in FIG. 11A, the difference in the heat storage count amount between the heat storage reduction region and the heat storage maximum region increases with the paper passing. As shown in FIG. 11C, on the 50th print, the difference in the heat storage count amount reached 156, and the deviation force from the heat storage reduction region to the heat storage maximum region has increased, causing damage to the center of the fixing film.

In the printing of an image under the paper passing condition 2, as shown in FIG. 12A, in the heating regions ($A_3$, $A_4$, and $A_5$) which are the heat storage maximum regions, the heat storage count values ($CT_3$, $CT_4$, and $CT_5$) increase as the number of prints increases. Since the heating regions ($A_3$, $A_4$, and $A_5$) are classified into the image heating regions AI, the control temperature TGT for the first print is set to 205° C., the heat storage count values ($CT_3$, $CT_4$, and $CT_5$) increase with the paper passing, and the heat storage count value for the 104th print reaches 244.5. Further, in the heating regions ($A_1$, $A_2$, $A_6$, and $A_7$) which are the heat storage reduction regions, since the regions are classified into the non-image heating regions AP, the non-image heating region temperature $T_{AP}$ for the first print is set to 105° C. Therefore, as the number of prints increases, the heat storage count values $CT_1$, $CT_2$, $CT_6$, and $CT_7$ increase, but do not increase more than the heat storage count values $CT_3$, $CT_4$, and $CT_5$, because the heat generation amount of the heating blocks is reduced. The heat storage count value of the 104th print is 44.1.

In the image under the paper passing condition 2, as described above, the width LCW of the heat storage reduction region in this case is 62.8 mm corresponding to the sum of the widths of the heating elements of the heating regions $A_1$ and $A_2$. Similarly, the width of the heat storage reduction region R on the opposite side in the longitudinal direction is 62.8 mm. The deviation determination value Y is set to 200 from Table 1. Therefore, the conditions of (Formula 2) and (Formula 3) described above are satisfied for the 104th paper passing number. Therefore, in the heating regions ($A_1$, $A_2$, $A_6$, and $A_7$) which are the heat storage reduction regions in the 105th print, the control temperature $TGT_i'$ is corrected and set as $TGT_i'=T_{AI}-K_{AI}$ by S1011 of the control flow shown in FIG. 6 so as to prevent the occurrence of film damage caused by deviation. The control temperature $TGT_i$ is 203° C.

As shown by the two-dot chain line in FIG. 12A, the increase in the heat storage count value after the 104th print in the heat storage reduction region is substantially the same as in the heat storage count values $CT_3$, $CT_4$, and $CT_5$ in the image region that is the heat storage maximum region. Therefore, as shown in FIG. 12B, the difference in the heat storage count amount between the heat storage reduction region and the heat storage maximum region is maintained at about 200, and does not become larger than a certain value. Therefore, no film damage occurs.

Meanwhile, in the control of the comparative example, as shown by the broken line in FIG. 12A, the difference in the heat storage count amount between the heat storage reduction region and the heat storage maximum region increases with the paper passing. As shown in FIG. 12C, on the 200-th print, the difference in the heat storage count amount reached 258, and the deviation force from the heat storage reduction region to the heat storage maximum region has increased, causing damage to the center of the fixing film.

In the printing of an image under the paper passing condition 3, as shown in FIG. 13A, in the heating regions ($A_2$, $A_3$, $A_4$, $A_5$, and $A_6$) which are the heat storage maximum regions, the heat storage count values ($CT_2$, $CT_3$, $CT_4$, $CT_5$, and $CT_6$) increase as the number of prints increases. Since the heating regions ($A_2$, $A_3$, $A_4$, $A_5$, and $A_6$) are classified into the image heating regions AI, the control temperature TGT for the first print is set to 205° C. The heat storage count values ($CT_2$, $CT_3$, $CT_4$, $CT_5$, and $CT_6$) increase with the paper passing, and the heat storage count value for the 270th print reaches 410.5. Further, in the heating regions ($A_1$ and $A_7$) which are the heat storage reduction regions, since the regions are classified into the non-image heating regions AP, the non-image heating region temperature $T_{AP}$ for the first print is set to 105° C. Therefore, as the number of prints increases, the heat storage count values $CT_1$ and $CT_7$ increase, but do not increase more than the heat storage count values ($CT_2$, $CT_3$, $CT_4$, $CT_5$, and $CT_6$), because the heat generation amount of the heating blocks is reduced. The heat storage count value of the 270th print is 110.5.

In the image under the paper passing condition 3, as described above, the width LCW of the heat storage reduction region is 31.4 mm corresponding to the heating region $A_1$. Similarly, the width of the heat storage reduction region R on the opposite side in the longitudinal direction is 31.4 mm. The deviation determination value Y is set to 300 from Table 1. Therefore, the conditions of (Formula 2) and (Formula 3) described above are satisfied for the 270th paper passing number. Therefore, in the heating regions ($A_1$ and $A_7$) which are the heat storage reduction regions in the 271th print, the control temperature $TGT_i'$ is corrected and set as $TGT_i'=T_{AI}-K_{AI}$ by S1011 of the control flow shown in FIG. 6 so as to prevent the occurrence of film damage caused by deviation. The control temperature $TGT_i$ is 195° C.

As shown by the two-dot chain line in FIG. 13A, the increase in the heat storage count value after the 271th print in the heat storage reduction region is substantially the same as in the heat storage count values ($CT_2$, $CT_3$, $CT_4$, $CT_5$, and $CT_6$) in the image region that is the heat storage maximum region. Therefore, as shown in FIG. 13B, the difference in the heat storage count amount between the heat storage reduction region and the heat storage maximum region is maintained at about 300, and does not become larger than a certain value. Therefore, no film damage occurs.

Meanwhile, in the control of the comparative example, as shown by the broken line in FIG. 13A, the difference in the heat storage count amount between the heat storage reduction region and the heat storage maximum region increases with the paper passing. As shown in FIG. 13C, on the 400th print, the difference in the heat storage count amount reached 378, and the deviation force acting on the fixing film from the heat storage reduction region to the heat storage maximum region has increased, causing damage to the center of the fixing film.

As described above, in the present embodiment, by setting the determination value based on the heat storage reduction region width, the difference in the heat storage amount between the heat storage reduction region and the heat storage maximum region does not exceed the allowable value and does not become larger than a certain value without. As a result, the film deviation force acting on the fixing film from the heat storage reduction region to the heat storage maximum region can be maintained within a predetermined range without increasing and exceeding the fracture limit. The damage to the fixing film caused by such force can be suppressed.

Further, it is possible to reduce the heat generation amount in the non-image region and achieve power saving.

Embodiment 2

Next, Embodiment 2 of the present invention will be described. In Embodiment 2, the determination is made based on the width of the heat storage reduction region and the average value of the heat storage count value. The basic configuration and operation of the image forming apparatus and the image heating device of Embodiment 2 are the same as those of Embodiment 1. Therefore, in Embodiment 2, elements having the same or equivalent functions and configurations as in Embodiment 1 are denoted by the same reference numerals, and detailed description thereof is omitted. In Embodiment 2, items that are not particularly described herein are the same as those in Embodiment 1.

10. Method for Setting Control Target Temperature

Figure 14:
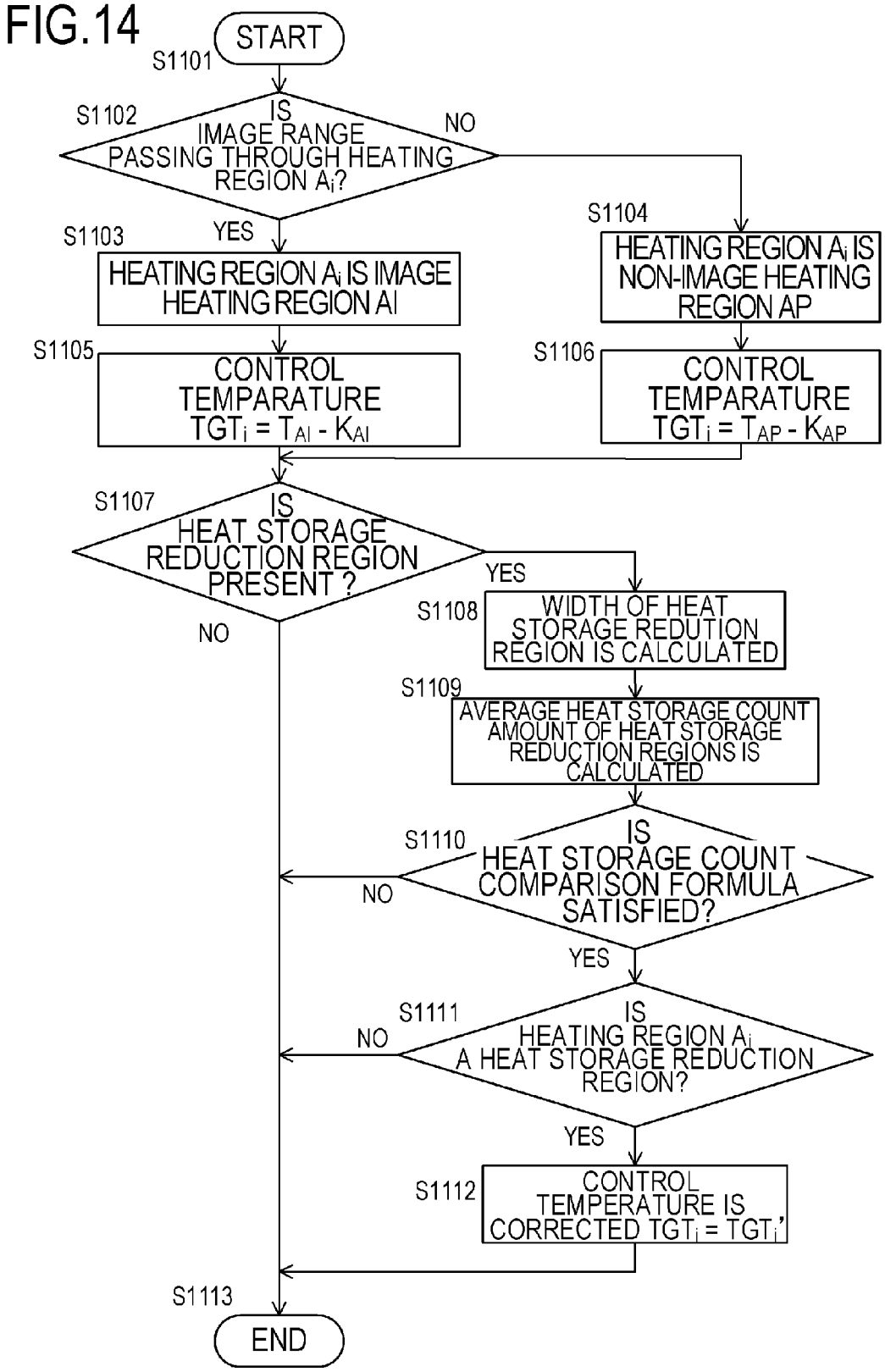
FIG. 14 is a flowchart for determining the classification of heating regions and the control temperature in Embodiment 2.

FIG. 14 is a flowchart for determining the classification of the heating regions and the control temperature in the present embodiment.

Each heating region $A_i$ (i=1 to 7) is classified into an image heating region AI and a non-image heating region AP as shown in the flowchart of FIG. 14.

The classification of the heating regions $A_i$ is performed based on image data (image information) and recording material information (recording material size) sent from an external device (not shown) such as a host computer. That is, whether the heating region $A_i$ is the image range is determined from the image data (image information) (S1102). Where the heating region is the image range, the heating region $A_i$ is classified as the image heating region AI (S1103), and where the heating region is not the heating range, the heating region $A_i$ is classified as the non-image heating region AP (S1104). The classification of the heating region $A_i$ is used for controlling the heat generation amount of the heating blocks $HB_i$, as described hereinbelow.

Where the heating region is classified as the image heating region AI, the control temperature $TGT_i$ is set as $TGT_i=T_{AI}-K_{AI}$ (S1105).

Here, $T_{AI}$ is an image heating region reference temperature, and is set as an appropriate temperature for fixing an unfixed image to the recording material P. Where the plain paper is passed in the fixing device 200 of the present embodiment, $T_{AI}$ is set to 205° C. It is desirable that the image heating reference temperature $T_{AI}$ be variable according to the type of the recording material P such as thick paper or thin paper. Further, the image heating region reference temperature $T_{AI}$ may be adjusted according to image information such as image density and pixel density.

Further, $K_{AI}$ is an image heating region temperature correction term, and is set according to the heat storage count value $CT_i$ in each heating region $A_i$ as shown in FIG. 8E. Here, the heat storage count value $CT_i$ is a parameter correlated with the heat storage amount of the fixing device 200 in each heating region $A_i$, and indicates that the larger the heat storage count value $CT_i$, the larger the heat storage amount. Next, the case where the heating region $A_i$ is classified as the non-image heating region AP (S1104) will be described. Where the heating region $A_i$ is classified as the non-image heating region AP, the control temperature $TGT_i$ is set as $TGT_i=T_{AP}-K_{AP}$ (S1106).

Here, $T_{AP}$ is a non-image heating region reference temperature, and is set to be lower than the image heating reference temperature $T_{AI}$, thereby lowering the heat generation amount of the heating block $HB_i$ in the non-image heating region AP with respect to that in the image heating region AI and saving the power of the image forming apparatus 100. In the present embodiment, the non-image heating region reference temperature $T_{AP}$ is set to 105° C.

It is desirable that the non-image heating reference temperature $T_{AP}$ be variable according to the type of the recording material P such as thick paper or thin paper.

Further, $K_{AP}$ is a non-image heating region temperature correction term, and as shown in FIG. 8E, the non-image heating region temperature correction term $K_{AP}$ is set to increase as the heat storage count value $CT_i$ in each heating region $A_i$ increases, that is, as the heat storage amount in each heating region $A_i$ increases. In the image forming apparatus 100 of the present embodiment, the value of the non-image heating region temperature correction term $K_{AP}$ is set to increase as the heat storage amount (heat storage count value $CT_i$) increases, the control temperature $TGT_i$ is lowered, and the heat generation amount of the heat generation block $HB_i$ is reduced. This prevents an excessive amount of heat from being applied to the fixing device 200 when the heat storage amount in the heating region $A_i$ is large, thereby achieving power saving.

Next, (S1107) will be described. In S1107, the heat storage count values of the heating regions are compared to determine whether there is a heat storage reduction region. First, a region having a maximum heat storage amount (heat storage count value) among the heating regions is defined as a heat storage maximum region, and a region having a smaller heat storage amount (heat storage count value) than the maximum heat storage amount region is defined as a heat storage reduction region.

Figure 15A:
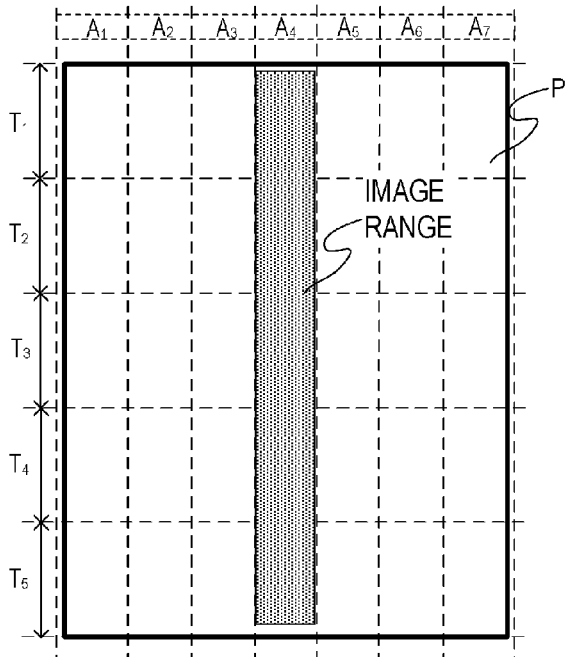
FIGS. 15A to 15C are diagrams illustrating a specific example in Embodiment 2.
Figure 15B:
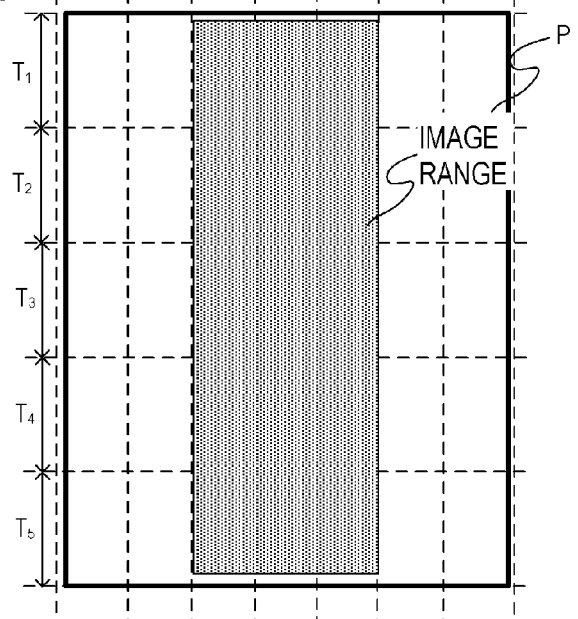

A specific print example will be described with reference to FIGS. 15A to 15C. FIGS. 15A and 15B show an image region on a recording material. In FIG. 15A, an image is arranged in a range of the heating region $A_4$ of a recording material (LTR size: paper width 216 mm, paper length 279 mm, basis weight 75 g/cm$^2$). Similarly, in FIG. 15B, an image is arranged in $A_3$, $A_4$, and $A_5$.

Figure 15C:
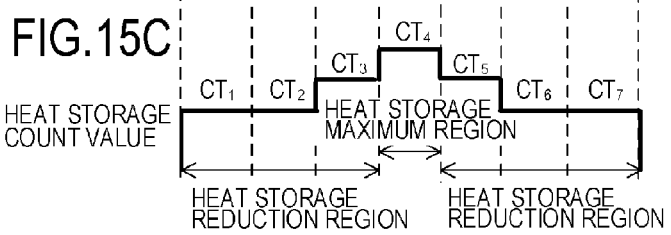

Further, FIG. 15C shows the state of the heat storage count value when the images shown in FIGS. 15A and 15B are alternately and continuously passed. Since the heating region $A_4$ is an image region in the paper passing of FIG. 15A, the control temperature corresponds to the image heating region. Meanwhile, the heating regions $A_1$, $A_2$, $A_3$, $A_5$, $A_6$, and $A_7$ are non-image regions, and have lower control temperatures than the image region.

Since the heating regions $A_3$, $A_4$, and $A_5$ are image regions in the paper passing in FIG. 15B, the control temperature corresponds to the image heating region. Meanwhile, the heating regions $A_1$, $A_2$, $A_6$, and $A_7$ are non-image regions, and have lower control temperatures than the image regions.

Therefore, as shown in FIG. 15B, the heat storage state (heat storage count value) of the heating regions $A_1$, $A_2$, $A_3$, $A_5$, $A_6$, and $A_7$ is smaller than the heat storage state (heat storage count value) of the heating region $A_4$.

In this case, the heating region $A_4$ is the heat storage maximum region. Further, the heat storage count values of the heating regions $A_1$, $A_2$, $A_3$, $A_5$, $A_6$, and $A_7$ are smaller than that of the heat storage maximum region, and therefore these regions become heat storage reduction regions. Further, since the heat storage reduction regions are located on both sides in the longitudinal direction of the heat storage maximum region under the present paper passing condition, $A_1$, $A_2$, and $A_3$, which are the heating regions on the left side in the longitudinal direction in the figure, are defined as heat storage reduction regions L, and $A_5$, $A_6$, and $A_7$, which are on the right side in the longitudinal direction, are defined as heat storage reduction regions R.

Next, where the heat storage reduction region is present in S1107, the processing advances to S1108 to calculate the width LCW of the heat storage reduction region.

Meanwhile, where the heat storage reduction region is not present, the temperature control is performed by the control temperature determined in S1105.

Calculation of the width LCW of the heat storage reduction region performed when the processing has advanced to S1108 will be described hereinbelow.

When there is only one heating region as in Embodiment 1, the heat storage reduction region width L is 31.4 mm corresponding to the width of the heating element in the heating region.

When the heat storage reduction regions are adjacent to each other, the width is 62.8 mm or 94.2 mm corresponding to the sum of the heating element widths in the heat storage reduction region width.

Next, processing advances to S1109 and the average heat storage count amount in the heat storage reduction region is calculated.

When images with different image regions are passed as shown in FIGS. 15A and 15B, the heat storage count values in the heat storage regions are different as shown in FIG. 15C. Therefore, it is necessary to calculate and determine the heat storage state of the entire heat storage reduction region from the heat storage count value of each heating region. Therefore, in Embodiment 2, the average heat storage count value $CT_{Lave}$ of the heat storage reduction region L and the average heat storage count value $CT_{Rave}$ of the heat storage reduction region R are calculated. In the print example shown in FIGS. 15A to 15C, the average of the heat storage count values in $CT_1$, $CT_2$, and $CT_3$ is the average heat storage count value $CT_{Lave}$, and the average of the heat storage count values in $CT_5$, $CT_6$, and $CT_7$ is the heat storage count value $CT_{Rave}$.

Next, in S1110, it is determined whether the heat storage count value satisfies the following heat storage count comparison formulas.

$$CT_{max}-CT_{Lave}>Y \quad \text{(Formula 4)}$$

$$CT_{max}-CT_{Rave}>Y \quad \text{(Formula 5)}$$

Here, $CT_{max}$ is the heat storage count value of the heat storage maximum region, $CT_{Lave}$ is the average heat storage count value of the heat storage reduction region L, and $CT_{Rave}$ is the average heat storage count value of the heat storage reduction region R. Y is a deviation determination value.

Further, the deviation determination value Y is determined from the heat storage reduction region width LCW as shown in Table 1. The heat storage reduction region width LCW is the heat storage reduction region width calculated in S1108.

Next, S1110 will be described in detail. In S1110, it is determined whether or not the fixing film is receiving a deviation force of a predetermined amount or more in the direction of the heat storage maximum region. As described above, the heat storage count value CT is a parameter correlated with the heat storage amount of the member of the image heating device in each heating region, and indicates that the larger is the heat storage count value, the larger is the heat storage amount. Therefore, the larger the heat storage count value CT, the larger the heat storage amount and the larger the outer diameter of the pressure roller. As mentioned hereinabove, the heat storage count value CT is also a parameter correlated with the outer diameter of the pressure roller. Therefore, where images under the paper passing conditions shown in FIGS. 15A to 15C are continuously printed, the maximum heat storage count value $CT_{max}$ becomes larger than the heat storage count value $CT_{Lave}$, and in such a state, the outer diameter of the pressure roller in the heat storage maximum region expands more than the outer diameter of the pressure roller in the heat storage reduction region. As a result, the deviation force acting on the fixing film in the direction from the heat storage reduction region to the heat storage maximum region increases.

Here, the present inventors have found that where the difference between the heat storage amount of the heat storage maximum region and the average heat storage amount of the heat storage reduction regions is equal to or more than the film deviation determination value, the fixing film exceeds the film fracture limit due to the increase in the force causing deviation from the heat storage reduction region to the heat storage maximum region, and wrinkles occur in the center of the film, causing damage. It has also been found that this film deviation determination value is correlated with the heat storage reduction region width LCW.

As shown in Embodiment 1, it was found that the larger the heat storage reduction region width LCW, the greater the deviation force in the direction of the heat storage maximum region, and the film is damaged at a small difference in heat storage amount. Therefore, the film center deviation determination value Y in the present embodiment is set by the heat storage reduction region width LCW as shown in Table 1, and it is determined whether or not the film is damaged by the heat storage count comparison formulas (Formula 4) and (Formula 5).

When the determination criteria are satisfied in S1110, the processing advances to S1111, it is determined whether the heating region $A_i$ is the heat storage reduction region, and the control temperature $TGT_i'$ is set so that no film damage occurs due to the film deviation.

Here, the control temperature $TGT_i$ is set to $TGT_i'=T_{AI}-K_{AI}$ irrespective of whether or not the image range passes through the heat storage reduction region (S1112).

$T_{AI}$ is an image heating region reference temperature, and $K_{AI}$ is an image heating region temperature correction term, and these are the same as those set in S1105.

Due to the control temperature correction in S1112, even when the image does not pass through the heat storage reduction region as in the image pattern shown in FIGS. 15A to 15C, the increase in the difference in heat storage count value can be suppressed and maintained within a predetermined range by performing heating at the same level as in the image heating region.

Therefore, even if the film deviation force acting on the fixing film from the heat storage reduction region to the heat storage maximum region increases, the force can be maintained in a predetermined range without exceeding the fracture limit. Therefore, damage to the fixing film can be suppressed.

As described above, in the present Embodiment 2, the control temperature $TGT_i$ for each heating region $A_i$ is determined according to the classification of the heating region $A_i$ and the heat storage count value $CT_i$. The set values of each heating region reference temperature ($T_{AI}$·$T_{AP}$), each heating region temperature correction term ($K_{AI}$·$K_{AP}$), and the deviation determination value Y need to be determined, as appropriate, by taking into account the configuration and printing conditions of the image forming apparatus 100 and the fixing device 200. That is, the above-described values are not limiting.

11. Effects of the Present Embodiment

Next, the effects of the present embodiment will be described with reference to a specific example shown below as a specific print example. In the specific example of Embodiment 2, continuous alternate printing of images shown in FIGS. 15A and 15B was performed on the recording material (LTR size: paper width 216 mm, paper length 279 mm, and basis weight 75 g/m$^2$) from the room temperature state of the fixing device 200, that is, from the state where the heat storage count value $CT_i$ of each heating region $A_i$ is 0.

Figures 16A, 16B:
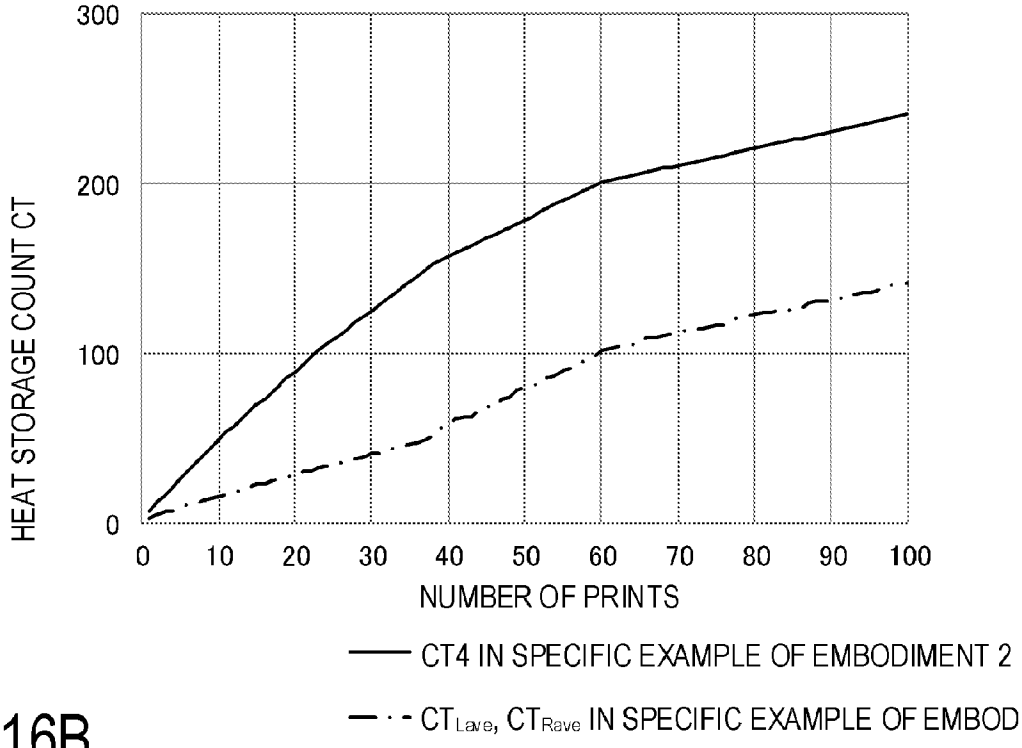
FIGS. 16A and 16B are diagrams illustrating the effect exerted in Embodiment 2.

FIG. 16A shows how the heat storage count value $CT_i$ of the heating region $A_i$ changes with respect to the paper passing number of the recording material.

FIG. 16B shows the control temperature, the heat storage count value, the difference in heat storage count values, and the presence or absence of damage due to the center deviation of the fixing film depending on the paper passing number.

The solid line represents the transition of the heat storage count value CT of the heating region which is a heat storage maximum region in Embodiment 2.

The two-dot chain line represents the transition of the average heat storage count values $CT_{Lave}$ and $CT_{Rave}$ of the heating region classified into the heat storage reduction region in Embodiment 2.

In the printing of an image under the paper passing condition of the specific example of Embodiment 2, as shown by a solid line in FIG. 16A, in the heating region ($A_4$) which is the heat storage maximum region, the heat storage count value ($CT_4$) increases as the number of prints increases. Since the heating region ($A_4$) is classified into the image heating regions AI, the control temperature TGT for the first print is set to 205° C. The heat storage count value $CT_4$ increases with the paper passing, and the heat storage count value for the 37th print reaches 148.7.

Further, in the heating regions ($A_1$, $A_2$, $A_6$, and $A_7$) which are the heat storage reduction regions, since the regions are classified into the non-image heating regions AP, the non-image heating region temperature $T_{AP}$ for the first print is set to 105° C. Therefore, as the number of prints increases, the heat storage count values ($CT_1$, $CT_2$, $CT_6$, and $CT_7$) increase, but do not increase more than the heat storage count value $CT_4$ because the heat generation amount of the heating blocks is reduced.

Further, in the heating regions ($A_3$ and $A_5$) which are the heat storage reduction regions, in the print shown in FIG. 15A, since the regions are classified into the non-image heating regions AP, the temperature is set to the non-image heating region temperature. In the print shown in FIG. 15B, since the heating region ($A_4$) is classified into the image heating region AI, the temperature is set to the image heating region temperature $T_{AI}$. Therefore, as the number of prints increases, the heat storage count values ($CT_3$ and $CT_5$) increase, but do not increase more than the heat storage count value $CT_4$.

The heat storage amount of the entire heat storage reduction region can be represented by the average heat storage count value calculated in S1109 of FIG. 14, and as shown in FIG. 16B, the average heat storage count value $CT_{Lave}$ and $CT_{Rave}$ of the heat storage reduction region on the 37th print reaches 47.7.

In the image under this paper passing condition, as described above, the heat storage reduction region width in this case is 94.2 mm, and the deviation determination value Y is set to 100 from Table 1. Therefore, the conditions of (Formula 4) and (Formula 5) shown in S1110 of the above-described control flow shown in FIG. 14 are satisfied for the 38th paper passing number. Therefore, in the heating regions ($A_1$, $A_2$, $A_3$, $A_5$, $A_6$, and $A_7$) which are the heat storage reduction regions in the 38th print, the control temperature is corrected to the control temperature $TGT_i'$ by S1112 of the control flow shown in FIG. 14 so as to prevent the occurrence of film damage caused by deviation. The control temperature $TGT_i$ of the heating regions ($A_1$, $A_2$, $A_6$, and $A_7$) is set to 203° C., and the control temperature $TGT_i$ of the heating regions ($A_3$ and $A_5$) is set to 195° C.

As shown by the two-dot chain line in FIG. 16A, the increase in the heat storage count value after the 38th print in the heat storage reduction region is substantially the same as in the heat storage count value $CT_4$ in the image region that is the heat storage maximum region. Therefore, as shown in FIG. 16B, the difference in the heat storage count amount between the heat storage reduction region and the heat storage maximum region is maintained at about 100. Therefore, no film damage occurs.

As described above, in the present embodiment, by setting the determination value based on the heat storage reduction region width, the difference in the heat storage amount between the heat storage reduction region and the heat storage maximum region does not become larger than a certain value and does not exceed the allowable value. As a result, the film deviation force acting on the fixing film from the heat storage reduction region to the heat storage maximum region can be maintained within a predetermined range without increasing and exceeding the fracture limit. The damage to the fixing film caused by such force can be suppressed.

Further, it is possible to reduce the heat generation amount in the non-image region and achieve power saving.

As described above, even if the film deviation force increases from the heat storage reduction region to the heat storage maximum region, this force can be maintained in the predetermined range without exceeding the fracture limit. Therefore, damage to the fixing film can be suppressed.

Further, by changing the control temperature $TGT_i$ in the image region AI and the non-image region AP, it is possible to reduce the amount of heat generated in the non-image region and achieve power saving.

Embodiment 3

Next, Embodiment 3 of the present invention will be described. Embodiment 3 has a fixing configuration using a heater having a different heating region width, and the determination is performed by calculating the heat storage amount by member temperature calculation using a heat transfer model. The basic configuration and operation of the image forming apparatus and the image heating device of Embodiment 3 are the same as those of Embodiment 1. Therefore, in Embodiment 3, elements having the same or equivalent functions and configurations as in Embodiment 1 are denoted by the same reference numerals, and detailed description thereof is omitted. Items that are not particularly described in Embodiment 3 are the same as those in Embodiment 1.

12. Heater Configuration

Figures 17A, 17B:
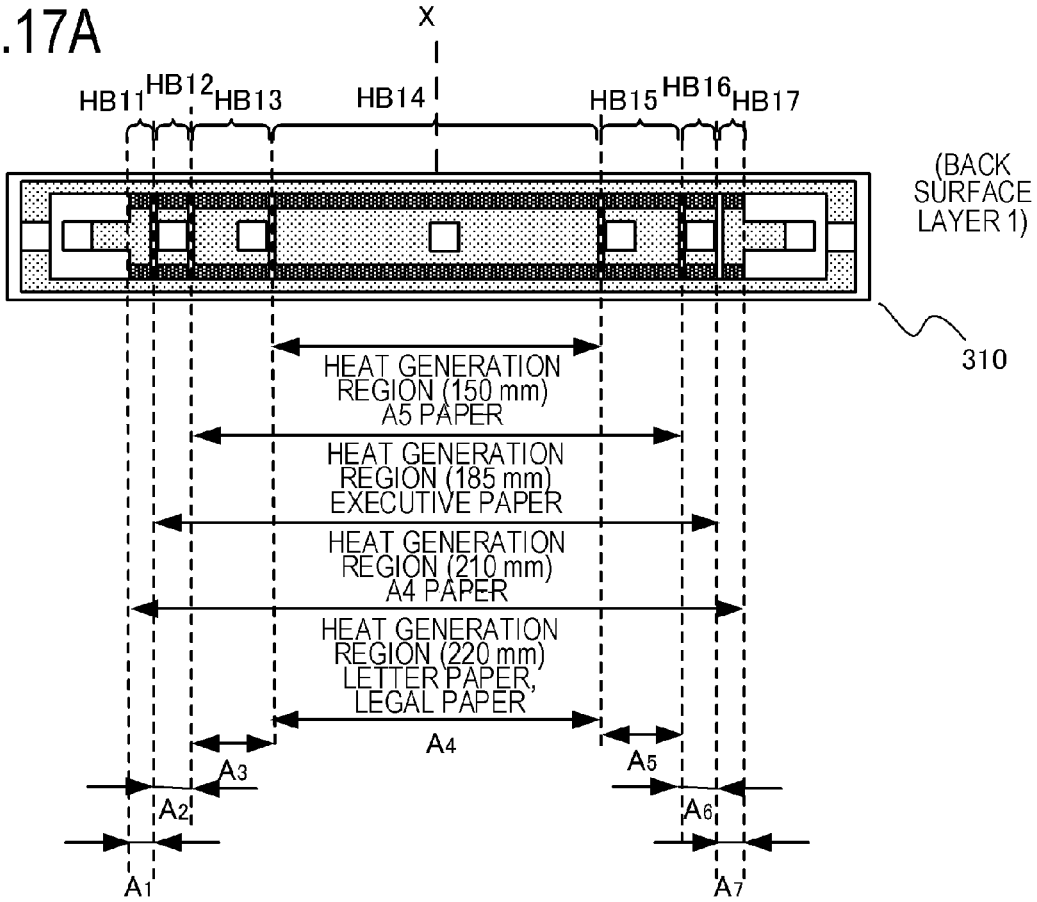
FIGS. 17A and 17B are heater configuration diagrams of Embodiment 3.

The configuration of a heater 310 according to the present embodiment will be described with reference to FIGS. 17A and 17B. FIG. 17A is a schematic plan view of the heater according to Embodiment 3.

FIG. 17A illustrates the conveyance reference position X of the recording material P in the image forming apparatus 100 of the present embodiment. In the present embodiment, the conveyance reference is the center reference, and the recording material P is conveyed so that the center line in the direction orthogonal to the conveyance direction thereof is along the conveyance reference position X.

The heater 310 is divided into seven heating blocks (HB11 to HB17) in the longitudinal direction. The heat generation range of the present embodiment is a range from the left end of the heating block HB11 in the drawing to the right end of the heating block HB17 in the drawing, and the total length thereof is 220 mm. As for the length of each heating block in the longitudinal direction, as shown in FIG. 17B, since each heating region is designed according to the size of the recording material, the length of the heating element of each heating block in the longitudinal direction is different.

13. Calculation Method of Heat Storage Amount

Figure 18A:
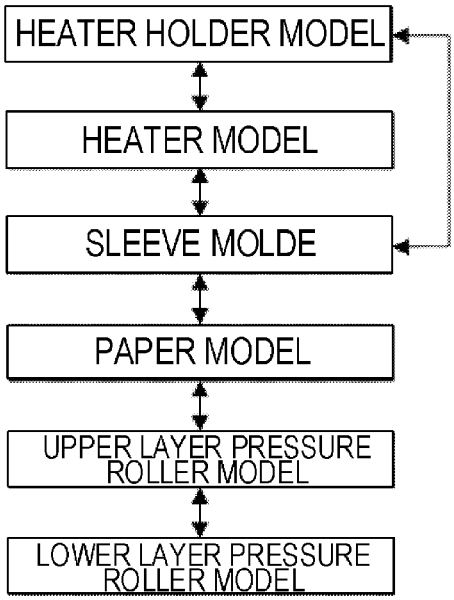
FIGS. 18A and 18B are heat transfer model diagrams in Embodiment 3.
Figure 18B:
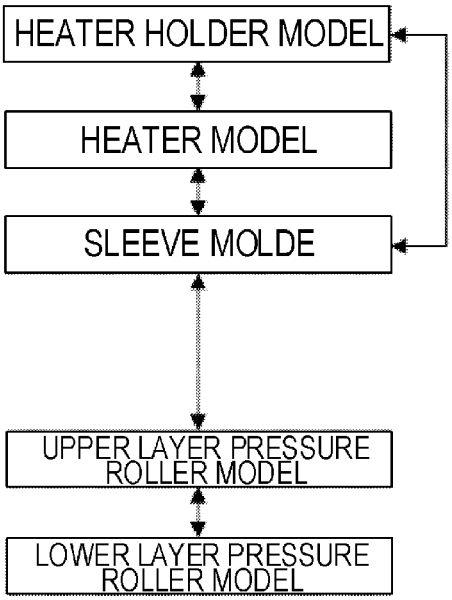

A method for estimating the temperature of the constituent members of the image heating device will be described using a heat transfer model shown in FIGS. 18A and 18B. FIGS. 18A and 18B is a simplified representation of heat conduction between the members constituting the fixing device 200, and the arrows in the figure indicate the heat transfer paths between the members that come into contact with each other. FIG. 18A shows a model when the recording material P passes through the nip portion N, and FIG. 18B shows a model when the recording material P does not pass.

The temperature of each member model in FIG. 18A can be estimated by the following difference formulas, where the number of samplings is k (the sampling time period is, for example, 10 msec) and n is an integer equal to or less than k. In addition, the coefficients of S1, R1, H1, L1, U1, P1, S2, R2, H2, and P2 are fitted to minimize an error between the measured temperature value of each member (heater holding member temperature, fixing film temperature, recording material temperature, pressure roller (pressing member) temperature) measured in a test and an estimated value obtained from the following formulas. Examples of the temperature of each member include a heater holding member temperature, a fixing film temperature, a recording material temperature, a pressure roller temperature, and the like.

$$Tp(k)=S1\{Ts(k-1)+\ldots+Ts(k-n)\}+R1\{Tr(k-1)+\ldots+Tr(k-n)\} \quad \text{(Formula 6)}$$

$$Ts(k)=H1\{Th(k-1)+\ldots+Th(k-n)\}+L1\{Tl(k-1)+\ldots+Tl(k-n)\}+P1\{Tp(k-1)+\ldots+Tp(k-n)\} \quad \text{(Formula 7)}$$

$$Tl(k)=H2\{Th(k-1)+\ldots+Th(k-n)\}+S2\{Ts(k-1)+\ldots+Ts(k-n)\} \quad \text{(Formula 8)}$$

$$Tr(k)=P2\{Tp(k-1)+\ldots+Tp(k-n)\}+U2\{Tu(k-1)+\ldots+Tu(k-n)\} \quad \text{(Formula 9)}$$

$$Tu(k)=R2\{Tr(k-1)+\ldots+Tr(k-n)\} \quad \text{(Formula 10)}$$

Tp: recording material temperature, Ts: fixing film temperature, Th: heater temperature, Tl: heater holding member temperature, Tr: upper layer pressure roller temperature, Tu: lower layer pressure roller temperature.

The detection result of the thermistor is used for the heater temperature Th.

Similarly, the temperature of each member model in FIG. 18B can be estimated by the following formulas. Except for the fixing film temperature and the upper layer pressure roller temperature, the same formulas as those in FIG. 18A are used. Further, the coefficients of R3 and S3 are fitted so that an error from a measured value obtained by the test is minimized.

$$Ts(k)=H1\{Th(k-1)+\ldots+Th(k-n)\}+L1\{Tl(k-1)+\ldots+Tl(k-n)\}+R3\{Tr(k-1)+Tr(k-n)\} \quad \text{(Formula 11)}$$

$$Tr(k)=S3\{Ts(k-1)+\ldots+Ts(k-n)\}+U1\{Tu(k-1)+\ldots+Tu(k-n)\} \quad \text{(Formula 12)}$$

Next, switching of the heat transfer model according to the operation state of the fixing device 200 will be described. The fixing film 202 and the pressure roller 208 of the fixing device 200 are rotated by the driving force of a driving motor during the printing operation (during the image forming operation), but stop when the printing operation is completed. The temperature estimation of each member using the heat transfer model of the present embodiment is performed by real time calculation during the printing operation and after the printing operation is completed.

When estimating the temperature of each member of the fixing device in real time, the calculation is performed separately for the following three cases. That is, when the paper P passes through the nip portion N (the model in FIG. 18A), when the paper P does not pass through the nip portion N (the model in FIG. 18B), and when the rotating body of the fixing device is not rotating (the model in FIG. 18B).

As described above, in the present embodiment, the member temperature of the image heating device is estimated in real time.

14. Method for Setting Control Target Temperature

Figure 19:
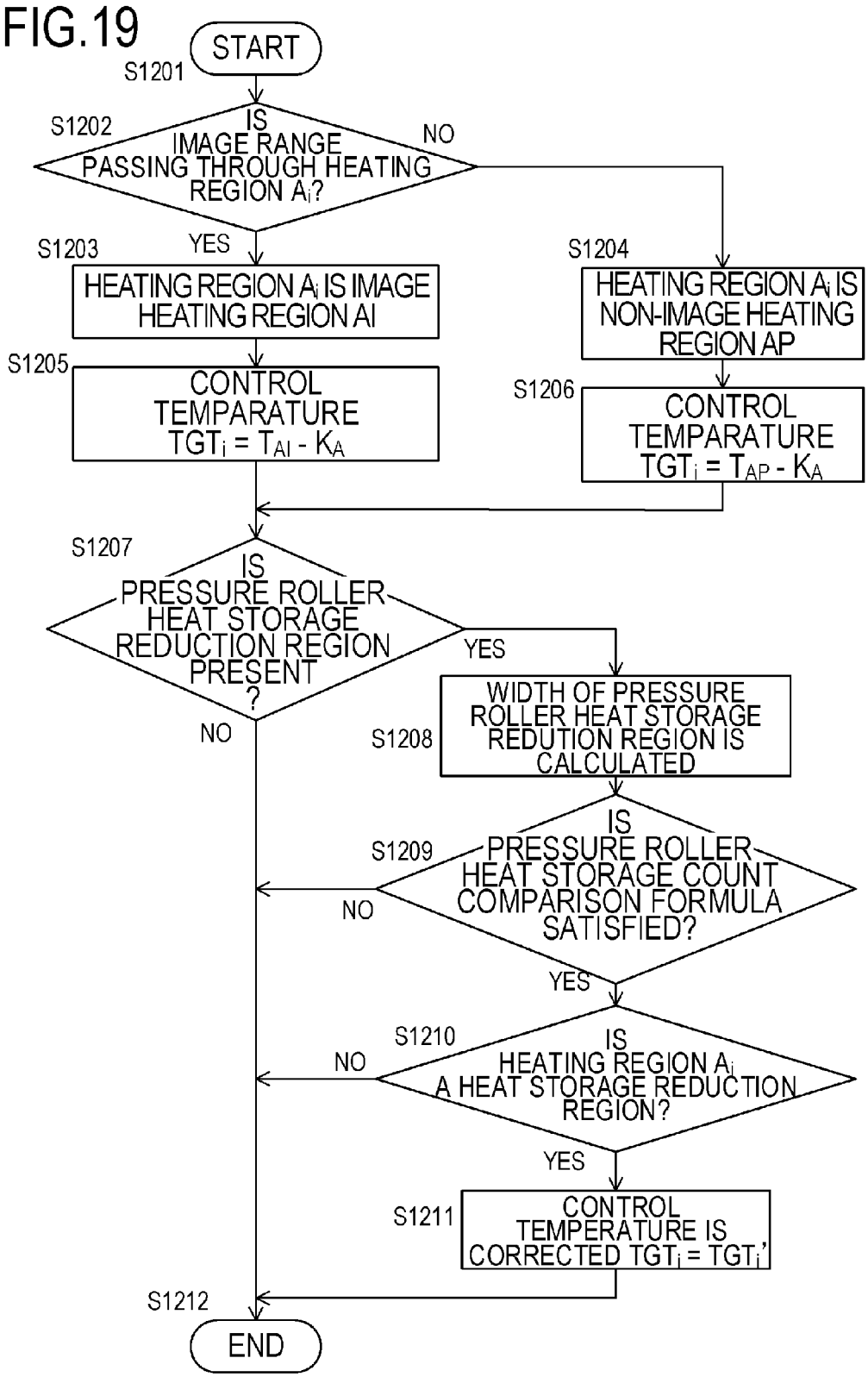
FIG. 19 is a flowchart for determining the classification of heating regions and the control temperature in Embodiment 3.

FIG. 19 is a flowchart for determining the classification of the heating regions and the control temperature in the present Embodiment 3.

Each heating region $A_i$ (i=1 to 7) is classified into an image heating region AI and a non-image heating region AP as shown in the flowchart of FIG. 19.

The classification of the heating regions $A_i$ is performed based on image data (image information) and recording material information (recording material size) sent from an external device (not shown) such as a host computer. That is, whether the heating region $A_i$ is the image range is determined from the image data (image information) (S1202). Where the heating region is the image range, the heating region $A_i$ is classified as the image heating region AI (S1203), and where the heating region is not the heating range, the heating region $A_i$ is classified as the non-image heating region AP (S1204). The classification of the heating region $A_i$ is used for controlling the heat generation amount of the heating blocks $HB_i$, as described hereinbelow.

Where the heating region is classified as the image heating region AI, the control temperature $TGT_i$ is set as $TGT_i=T_{AI}-K_{AI}$ (S1205).

Here, $T_{AI}$ is an image heating region reference temperature, and is set as an appropriate temperature for fixing an unfixed image to the recording material P. Where the plain paper is passed in the fixing device 200 of the present embodiment, $T_{AI}$ is set to 205° C. It is desirable that the image heating reference temperature $T_{AI}$ be variable according to the type of the recording material P such as thick paper or thin paper. Further, the image heating region reference temperature $T_{AI}$ may be adjusted according to image information such as image density and pixel density.

Further, $K_{AI}$ is an image heating region temperature correction term, and is set according to the pressure roller estimation temperature $T_{ri}$ calculated by the heat transfer model in each heating region $A_i$ as shown in FIG. 20A. Here, the pressure roller estimation temperature $T_{ri}$ is a parameter correlated with the heat storage amount of the fixing device 200 in each heating region $A_i$, and indicates that the larger the pressure roller estimation temperature $T_{ri}$, the larger the heat storage amount. That is, with the larger heat storage amount of the pressure roller in the heating region $A_i$ (the pressure roller estimation temperature $T_{ri}$ is high), the toner image can be fixed on the recording material P even with a smaller heat generation amount of the heat generation block $HB_i$. Therefore, in the image forming apparatus 100 of the present embodiment, the value of the image heating region temperature correction term $K_{AI}$ is set to increase as the heat storage amount of the pressure roller increases (the pressure roller estimation temperature $T_{ri}$ is high), the control temperature $TGT_i$ is lowered, and the heat generation amount of the heat generation block $HB_i$ is reduced. This prevents an excessive amount of heat from being applied to the toner image when the heat storage amount in the heating region $A_i$ is large, thereby achieving power saving.

Next, the case where the heating region $A_i$ is classified as the non-image heating region AP (S1204) will be described. Where the heating region $A_i$ is classified as the non-image heating region AP, the control temperature $TGT_i$ is set as $TGT_i=T_{AP}-K_{AP}$ (S1206).

Here, $T_{AP}$ is a non-image heating region reference temperature, and is set to be lower than the image heating reference temperature $T_{AI}$, thereby lowering the heat generation amount of the heating block $HB_i$ in the non-image heating region AP with respect to that in the image heating region AI and saving the power of the image forming apparatus 100. From the viewpoint of power saving, it is desirable that the non-image heating region reference temperature $T_{AP}$ be such that the control temperature $TGT_i$ be lowered as much as possible and the heat generation amount of the heating block $HB_i$ be reduced. Therefore, in the present embodiment, the non-image heating region reference temperature $T_{AP}$ is set to 105° C.

It is desirable that the non-image heating reference temperature $T_{AP}$ be variable according to the type of the recording material P such as thick paper or thin paper.

Further, $K_{AP}$ is a non-image heating region temperature correction term, and as shown in FIG. 20, the non-image heating region temperature correction term $K_{AP}$ is set to increase as the heat storage amount of the pressure roller in each heating region $A_i$ increases. Here, in the image forming apparatus 100 of the present Embodiment 3, the value of the non-image heating region temperature correction term $K_{AP}$ is set to increase as the heat storage amount of the pressure roller increases (the pressure roller estimation temperature $T_{ri}$ is high), the control temperature $TGT_i$ is lowered, and the heat generation amount of the heat generation block $HB_i$ is reduced. This prevents an excessive amount of heat from being applied to the fixing device 200 when the heat storage amount in the heating region $A_i$ is large, thereby achieving power saving.

Next, (S1207) will be described. In S1207, the estimated pressure roller temperatures of heating regions calculated by the heat transfer model are compared, and it is determined whether or not there is a pressure roller heat storage reduction region.

The region having the highest estimated pressure roller temperature among the heating regions $A_1$, $A_2$, $A_3$, and $A_4$, is defined as the heat storage maximum region $AL_{max}$, and the region having the highest estimated pressure roller temperature among the heating regions $A_4$, $A_5$, $A_6$, and $A_7$ is defined as the heat storage maximum region $AR_{max}$. Further, a region on the heating region $A_1$ side where the estimated pressure roller temperature is lower than that of the heat storage maximum region $AL_{max}$ is defined as a pressure roller heat storage reduction region L, and a region on the heating region $A_7$ side where the estimated pressure roller temperature is lower than that of the heat storage maximum region $AR_{max}$ is defined as a pressure roller heat storage reduction region R.

Next, where the pressure roller heat storage reduction region L and the pressure roller heat storage reduction region R are present in S1207, the processing shifts to S1208 to calculate the width LCW of the pressure roller heat storage reduction region.

In the case where a pressure roller heat storage reduction region is not present, the temperature control is performed at the control temperature determined in S1205.

The calculation of the width LCW of the heat storage reduction region when the processing shifts to S1208 will be described hereinbelow. Table 2 shows the correspondence between the heating region corresponding to the heat storage reduction region and the width LCW of the heat storage reduction region.

For example, when the heating region $A_1$ alone is present as the heat storage reduction region width L, the heat storage reduction region width L is 5.0 mm corresponding to the heating element width of the heating region $A_1$. Further, when the heat storage reduction regions are $A_1$ and $A_2$, they are adjacent to each other, and thus the heat storage reduction region width L is 17.5 mm corresponding to the sum of the heating element widths of the heating regions $A_1$ and $A_2$. When the heat storage reduction regions are $A_1$, $A_2$, and $A_3$, the heat storage reduction regions are adjacent to each other, and thus the heat storage reduction region width L is 35.0 mm corresponding to the sum of the heating element widths of the heating regions $A_1$, $A_2$, and $A_3$. For $A_5$, $A_6$, and $A_7$ on the opposite side in the longitudinal direction, the calculation is similarly performed based on Table 2.

Next, in S1209, it is determined whether the heat storage count value satisfies the following heat storage count comparison formulas.

$$T_{rLmax}-T_rL>P \quad \text{(Formula 13)}$$

$$T_{rRmax}-T_rR>P \quad \text{(Formula 14)}$$

Here, $T_{rLmax}$ is the estimated pressure roller temperature in the heat storage maximum region $A_{Lmax}$, and $T_{rRmax}$ is the estimated pressure roller temperature in the heat storage maximum region $A_{Rmax}$. Further, $T_rL$ is the minimum value of the estimated pressure roller temperature in the heat storage reduction region L, $T_rR$ is the minimum value of the estimated pressure roller temperature in the heat storage reduction region R, and P is the deviation determination value.

The deviation determination value P is determined from the heat storage reduction region width LCW as shown in Table 2. The heat storage reduction region width LCW is the heat storage reduction region width calculated in S1208.

TABLE 2

| Heat storage reduction region | Heat storage reduction region width LCW | Determination value P |
|---|---|---|
| A1 | 5.0 mm | 120° C. |
| A1 + A2 | 17.5 mm | 30° C. |
| A1 + A2 + A3 | 35.0 mm | 20° C. |
| A5 + A6 + A7 | 35.0 mm | 20° C. |
| A6 + A7 | 17.5 mm | 30° C. |
| A7 | 5.0 mm | 120° C. |

Next, S1210 will be described in detail. In step S1210, it is determined whether the fixing film is receiving a deviation force of a predetermined amount or more in the direction of the heat storage maximum region. As described above, the larger the estimated pressure roller temperature $T_r$, the larger the heat storage amount of the pressure roller and the larger the outer diameter thereof. As described above, the estimated pressure roller temperature $T_r$ is also a parameter correlated with the outer diameter of the pressure roller. As the difference between the estimated pressure roller temperature in the heat storage maximum region and the estimated pressure roller temperature in the heat storage reduction region increases, the difference in the outer diameter of the pressure roller also increases accordingly. Therefore, the deviation force acting on the fixing film in the direction from the heat storage reduction region where the outer diameter of the pressure roller is small to the heat storage maximum region where the outer diameter of the pressure roller is large increases.

The inventors have found that where the difference between the heat storage amount in the heat storage maximum region (estimated pressure roller temperature $T_r$) and the heat storage amount in the heat storage reduction region (estimated pressure roller temperature $T_r$) becomes equal to or more than the film deviation determination value, the deviation force acting on the fixing film from the heat storage reduction region to the heat storage maximum region increases, exceeds the film fracture limit and causes damage to the central portion of the film. In addition, it has been found that the film deviation determination value has a correlation with the heat storage reduction region width LCW.

Therefore, the film deviation determination value P in the present Embodiment 3 is set based on the heat storage reduction region width as shown in Table 2, and it is determined by the heat storage count comparison formulas as to whether or not the film is damaged (Formula 13 and Formula 14). Where the determination criterion of S1210 is satisfied, the processing advances to S1211, where it is determined whether the heating region $A_i$ is the heat storage reduction region, and the control temperature $TGT_i'$ is set so that the film is not damaged by the film deviation.

Here, the control temperature $TGT_i$ is set to $TGT_i'=T_{AI}-K_{AI}$ irrespective of whether or not the image range passes through the heat storage reduction region (S1211).

$T_{AI}$ is an image heating region reference temperature, and $K_{AI}$ is an image heating region temperature correction term, and these are the same as those set in S1203. When plain paper is passed in the present embodiment, $T_{AI}$ is set to 205° C.

With the above setting, even in a state where the image does not pass through the heat storage reduction region, by performing heat generation at the same level as in the image heating region, it is possible to suppress an increase in the difference in the heat storage count value and to maintain the difference within a predetermined range. Therefore, even if the film deviation force increases from the heat storage reduction region to the heat storage maximum region, the force can be maintained in the predetermined range without exceeding the fracture limit. Therefore, damage to the fixing film can be suppressed.

As described above, in the present embodiment, the control temperature $TGT_i$ for each heating region $A_i$ is determined according to the classification and the heat storage count value $CT_i$ of the heating region $A_i$. The set values of the heating region reference temperatures ($T_{AI}$·$T_{AP}$), the heating region temperature correction terms ($K_{AI}$·$K_{AP}$), and the deviation determination value P need to be determined, as appropriate, by taking into account the configurations and printing conditions of the image forming apparatus 100 and the fixing apparatus 200. That is, the above-described values are not limiting.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-078069, filed on Apr. 16, 2020, which is hereby incorporated by reference herein in its entirety.

What is claimed is:

1. An image heating device comprising:

a heating unit including a heater for heating an image formed on a recording material, wherein the heater having a plurality of heating elements arranged side by side in a direction perpendicular to a conveyance direction of the recording material; and a control portion that individually controls electric power supplied to the plurality of heating elements; wherein the device has an acquisition portion that acquires a plurality of count values representing a heat storage amount in each of a plurality of heating regions heated by the plurality of heating elements, the control portion controls electric power supplied to the plurality of heating elements so that a difference between a heat storage maximum count value and a heat storage reduction count value is maintained within a range of a predetermined value, the heat storage maximum count value is the count value representing the heat storage amount of the heating region in which the heat storage amount is the largest among the plurality of heating regions, the heat storage reduction count value is the count value representing the heat storage amount of a heat storage reduction region that is a heating region having a smaller heat storage amount than the heating region having the maximum heat storage amount among the plurality of heating regions, and the predetermined value is set based on a width of the heat storage reduction region in the direction orthogonal to the conveyance direction.

2. The image heating device according to claim 1, wherein where there is a plurality of heating regions serving as the heat storage reduction region, the smallest count value of the count values of the plurality of heating regions serving as the heat storage reduction region is taken as the heat storage reduction count value.

3. The image heating device according to claim 1, wherein where there is a plurality of heating regions serving as the heat storage reduction region, an average heat storage count value obtained by averaging the count values of the plurality of heating regions serving as the heat storage reduction region is acquired, and the average heat storage count value is taken as the heat storage reduction count value.

4. The image heating device according to claim 1, wherein the control portion individually controls electric power supplied to the plurality of heating elements based on image information formed on the recording material.

5. The image heating device according to claim 1, wherein when the difference between the heat storage maximum count value and the heat storage reduction count value is larger than the predetermined value, the control portion controls electric power supplied to a heating element for heating a heating region serving as the heat storage reduction region among the plurality of heating elements so that the difference is within a predetermined range.

6. The image heating device according to claim 1, wherein the device further comprises a temperature detecting means for detecting a temperature of the heater for each of the plurality of heating regions, and the control portion controls electric power supplied to the plurality of heating elements so that the temperature detected by the temperature detecting means maintains a predetermined control target temperature.

7. The image heating device according to claim 1, wherein the plurality of heating elements have different widths in the direction orthogonal to the conveyance direction.

8. The image heating device according to claim 1, wherein the device further has a tubular film;

the heater further includes a substrate on which the plurality of heating elements are provided, the direction orthogonal to the conveyance direction being a longitudinal direction of the substrate; and the heating unit is in contact with an inner surface of the film.

9. An image heating device comprising:

a heating unit including a heater for heating an image formed on a recording material, wherein the heater having a plurality of heating elements arranged side by side in a direction perpendicular to a conveyance direction of the recording material; and a control portion that individually controls electric power supplied to the plurality of heating elements; wherein the device estimates the temperature of constituent members constituting the device and the temperature of the recording material in real time during an image forming operation of an image forming apparatus equipped with the device, and has an acquisition portion that acquires estimated temperatures of a plurality of regions of the constituent members corresponding to each of the plurality of heating regions heated by the plurality of heating elements;

the control portion sets a heating region corresponding to a region where the estimated temperature is highest among the plurality of regions as a heat storage maximum region, sets a heating region corresponding to a region where the estimated temperature is lower than in the region where the estimated temperature is highest among the plurality of regions as a heat storage reduction region, and controls electric power supplied to the plurality of heating elements so that a difference between the estimated temperature of the heat storage maximum region and the estimated temperature of the heat storage reduction region is maintained within a predetermined range, and the predetermined value is set based on a width of the heat storage reduction region in a direction orthogonal to the conveyance direction.

10. The image heating device according to claim 9, wherein the constituent members include the heating unit, a cylindrical film in which the heating unit contacts an inner surface, and a pressure member that forms a nip for holding a recording material between the film and the pressure member, and the heating unit further includes a holding member that holds the heater.

11. An image forming apparatus comprising:

an image forming portion that forms an image on a recording material; and a fixing portion that fixes the image formed on the recording material to the recording material;

the fixing portion including:

a heating unit including a heater for heating the image formed on a recording material, wherein the heater having a plurality of heating elements arranged side by side in a direction perpendicular to a conveyance direction of the recording material; and a control portion that individually controls electric power supplied to the plurality of heating elements; wherein the apparatus has an acquisition portion that acquires a plurality of count values representing a heat storage amount in each of a plurality of heating regions heated by the plurality of heating elements, the control portion controls electric power supplied to the plurality of heating elements so that a difference between a heat storage maximum count value and a heat storage reduction count value is maintained within a range of a predetermined value;

the heat storage maximum count value is the count value representing the heat storage amount of the heating region in which the heat storage amount is the largest among the plurality of heating regions;

the heat storage reduction count value is the count value representing the heat storage amount of a heat storage reduction region that is a heating region having a smaller heat storage amount than the heating region having the maximum heat storage amount among the plurality of heating regions, and the predetermined value is set based on a width of the heat storage reduction region in the direction orthogonal to the conveyance direction.

* * * * *